United States Patent [19]

Peters, Jr.

[11] 4,013,859

[45] Mar. 22, 1977

[54] INDUCTION COOKING UNIT HAVING COOKING LOAD SENSING DEVICE AND ESSENTIALLY ZERO STAND-BY POWER LOSS

[75] Inventor: Philip H. Peters, Jr., Greenwich, N.Y.

[73] Assignee: Environment/One Corporation, Schenectady, N.Y.

[22] Filed: June 4, 1975

[21] Appl. No.: 583,662

[52] U.S. Cl. ..... 219/10.49; 219/10.77; 321/18; 336/181

[51] Int. Cl.[2] ..... H05B 5/04

[58] Field of Search ..... 219/10.49, 10.77, 10.75, 219/10.79; 321/14, 18; 336/181

[56] References Cited

UNITED STATES PATENTS

| | | | |
|---|---|---|---|
| 3,770,928 | 11/1973 | Kornrumpf et al. | 219/10.49 |
| 3,796,850 | 3/1974 | Moreland et al. | 219/10.49 |
| 3,806,688 | 4/1974 | MacKenzie et al. | 219/10.49 |
| 3,973,105 | 8/1976 | Tsumori | 219/10.49 |

*Primary Examiner*—Bruce A. Reynolds
*Attorney, Agent, or Firm*—Charles W. Helzer

[57] ABSTRACT

An induction heating unit is provided having an essentially zero stand-by power requirement and comprised by a high power solid-state inverter for supplying relatively high frequency excitation currents to an induction heating coil, and including inhibit, delay, and starting and stopping gating circuits to control the operation of the high frequency power inverter. An induction heating load sensing device senses the presence of a load such as a pan or other metal base cookware located in induction heating relationship with respect to the induction heating coil. The pan presence sensing device comprises a very low power oscillator coupled to a load sensing coil for exciting the load sensing coil with high frequency oscillatory signals which preferably are in the range of two to three times the frequency at which the power inverter operates. The load sensing coil is physically positioned adjacent the induction heating coil in a location to provide inductive coupling of the high frequency sensing signal to a pan load suitably supported near the induction heating coil. The pan load sensing coil is designed to minimize the effect of inductive coupling to the induction heating coil, and for this purpose is provided with a multiple loop figure-eight or cloverleaf shape so designed and positioned that currents induced in the loops of the sensing coil by the magnetic field of the induction heating coil null one another at the terminals of the sensing coil. A load sensing detector responds to the magnitude of the high frequency voltage across the pan load sensing coil and controls the operation of the gating circuits of the power inverter in a load-selective manner to cause turn-on of the power inverter only in the presence of a proper pan load.

39 Claims, 16 Drawing Figures

18A OSCILLATOR
18B TWO STAGE DETECTOR
ON/OFF CONTROL SWITCH
18C SCHMITT TRIGGER
18D START PULSE GENERATOR AND INHIBITS
18E RUN PULSE GENERATOR
TO INV. SCR
TO L3
TO PAN TEMPERATURE SENSOR CONTROL
N.T.C.
O(L3) FLUX
□(L5) FLUX

INDUCTION COOKING UNIT HAVING COOKING LOAD SENSING DEVICE AND ESSENTIALLY ZERO STAND-BY POWER LOSS

BACKGROUND OF THE INVENTION

1. Field of Invention

This invention relates to a new and improved induction heating and cooking unit having little or no stand-by power loss, so as to afford as substantial reduction in the energy consumed in the performance of a cooking task.

Further, the invention relates to an induction cooking unit for use in home and commercial induction cooking ranges, which is capable of safely being used with existing or known metal base pans or other cooking vessels of any type without risk of damage to the induction cooking unit. The invention also relates to the matter of providing maximum protection to the user of the induction cooking unit against accidental burns which can be caused by small metallic articles which would become heated when left on the cooking surface unless the induction power is turned off while the unit is not being used for cooking.

2. Background of Invention

U.S. Pat. No. 3,710,062 issued Jan. 29, 1972 to Philip H. Peters, Jr. for Metal Base Cookware Induction Heating Apparatus Having Improved Power Supply and Gating Control Circuit Using Infra-Red Temperature Sensor and Improved Induction Heating Coil Arrangement — Assigned to the Environment/One Corporation of Schenectady, N.Y., describes and claims a range top induction cooking unit for use in home and commercial ranges. The induction cooking unit descried in U.S. Pat. No. 3,710,062 was designed to inductively heat pans and other metal base cookware which are fabricated from stainless steel, iron, titanium, and other similar lossy metallic materials. In U.S. Pat. No. 3,886,342 - issued May 27, 1975, Philip H. Peters, Jr., Inventor — Improved Induction Cooking Unit Having All Pan Safe Operation, Wide Range Power Control and Low Start-Up and Shut-Down Transients — Assigned to the Environment/One Corporation of Schenectady, N.Y., an improved all-pan induction cooking unit is disclosed which can be safely used with pans or other metal base cookware of any description without risk of serious damage to the induction cooking unit. The induction cooking unit described in U.S. Pat. No. 3,886,342 is designed to operate frm a conventional residential or commercial source of alternating current, and converts the alternating current to a full wave rectified direct current that then supplis a solid-state inverter which generates a current at a frequency of the order of 20 kilohertz in an induction cooking coil. An induction cooking unit that also is capable of operation with pans or other metal base cookware of all types and materials, and which is somewhat similar in construction and operation, is described in U.S. Pat. No. 3,898,410-issued Aug. 5, 1975 — Philip H. Peters, Jr., Inventor — Improved AC to RF Inverter Circuit for Induction Cooking Unit — Assigned to the Environment/One Corporation.

The present invention comprises a further improved all-pan and reliability, cooking unit similar to those described in U.S. Pat. No. 3,886,342 and U.S. Pat. No. 3,898,410, but which is designed to have an essentially zero stand-by power loss and to discriminate between a proper, lossy pan load and one which is fabricated from or externally clad with aluminum, copper, or other highly conductive material, and which further discriminates against small articles such as knives, forks, spoons, spatulas, etc., and does not turn on in the presence of such articles. As a consequence of these characteristics, the improved unit possesses greatly improved overall operating efficiency, safety, while being used in a kitchen or other area for the preparation and cooking of foodstuffs.

SUMMARY OF INVENTION

It is, therefore, a primary object of the present invention to provide a new and improved induction cooking unit which has essentially zero stand-by power losses when it is in a turned-on, stand-by condition and no suitable pan or other metal base cookware is located in the region adjacent to the induction heating load coil where normal cooking is designed to take place.

It is still a further object of the invention to provide such an induction cooking unit which if turned on is capable of being safely used with pans or other cooking vessels of all materials and types without risk of serious damage to the induction cooking unit.

Another object of the invention is to provide an induction cooking unit having the above-set forth characteristics which, while in a turned-on stand-by condition, will discriminate between different types of pans and other articles and will automatically turn-on to produce heating of a pan load only in the presence of a suitable lossy stainless steel or iron or iron alloy pan, and will not produce a heating induction field in the presence of highly conductive pans or improper loads such as pans made of or clad with aluminum or copper and small metallic articles such as forks, spoons, knives, spatulas, and the like, so as to provide a maximum of safety to the user.

Still another object of the invention is to provide an induction cooking unit which, because of the above-listed pan load discriminatory capabilities, will only turn full on from a stand-by condition in the presence of suitable lossy stainless steel or iron and iron alloy pan loads and, hence, will tend to operate only with a high efficiency.

Another object of the invention is to provide an induction cooking unit having a pan sensing and discriminating device which produces a minimum of electromagnetic interference and does not allow even the momentary turn on of the induction power inverter of the cooking unit in the presence of an inappropriate pan load.

It is still a further object of the invention to provide a new and improved pan load sensing device for induction cooking units which readily can be retrofitted to pre-existing induction cooking units to provide the above-listed desirable operating capabilities.

In practicing the invention, an induction heating unit having an essentially zero stand-by power requirement is provided which comprises high frequency power inverter circuit means for developing relatively high frequency power excitation currents that are supplied to an induction heating coil coupled to and excited by the high frequency power inverter circuit. Inhibit, delay, and starting and stopping gating circuit means are coupled to and control the operation of the high frequency power inverter circuit means. Induction heating load sensing means are provided for sensing the presence of a pan load located in induction heating relationship with respect to the induction heating coil. The pan load sensing means comprises very low power, high frequency oscillatory electric signal generating means coupled to and exciting a load sensing coil. The load sensing coil is physically positioned adjacent the induction heating coil in a location to provide inductive coupling of the high frequency oscillatory signal to a pan load which is or is to be inductively heated. The load sensing coil is designed in such a manner that inductive coupling to the induction heating coil is minimized. For this purpose, the load sensing coil is provided with a multiple figure-eight or cloverleaf configuration wherein currents induced in each of the loops by the current flowing in the induction heating coil null one another at the terminals of the sensing coil in contrast to the high frequency oscillatory signal currents flowing in the loops of the sensing coil which are additive in all of the loops and produce a high frequency magnetic field for sensing the presence or absence of suitable pan loads. Load sensing detector means are provided which are responsive to the high frequency oscillatory signal emitted by the load sensing coil for detecting changes induced in the high frequency signal due to the presence of absence of a suitable induction heating load. Means are provided for coupling the output from the detector means to control operation of the gating circuit means for the power inverter circuit whereby the detector means operates to turn-on the high frequency power inverter in the presence of a suitable pan load and in the absence of a suitable pan load to turn-off the inverter, thereby making the stand-by power consumption of the overall induction unit substantially zero.

In a preferred embodiment of the invention, the inverter circuit means comprises gate control thyristor means and commutation circuit means connected to excite an induction heating coil which, at least in part, determines the operating frequency at which the inverter circuit means operates. The gating circuit means for controlling turn-on of the gate control thyristor comprises start pulse control means and run pulse control means. The start pulse control means comprises start pulse generator means having its output coupled to supply initial turn-on gating pulses to the control gate of the gate control thyristor means. Enabling means are provided to initiate and control the operation of the start pulse gating signal generator means. The run pulse control means comprises feedback circuit means coupled to the induction heating coil for deriving a feedback signal at the operating frequency of the inverter circuit. The feedback circuit means maintains operation of the run pulse generator means which generates gate pulses having a repetition rate determined by the operating frequency of the inverter circuit means and having sufficient energy to assure the periodic turn-on of the gate control thyristor means. Enabling means are provided which are coupled to, and initiate and control operation of the run pulse gate signal generator means. The feedback circuit means causes the run pulse generator to produce gate signals at a rate which is synchronous with the resonant frequency of the inverter circuit so as to assure the efficient transfer of power to a variety of pan loads which may be expected to present widely different levels of impedance to the induction heating coil.

The output from the induction heating load sensing detector means for sensing the presence of a suitable pan load is connected to control turn-on of the start pulse generator means and to control the application and removal of a signal clamp or inhibit means maintained on both the start pulse generator and the run pulse generator. In the absence of a suitable pan load, the inhibit circuit means maintains both the start pulse generator and the run pulse generator clamped in a turned-off condition. Upon the appearance of a suitable pan load, the output from the pan load sensing detector removes the start pulse generator inhibit and, following a short time delay, enables the start pulse generator to supply a start pulse to the high frequency inverter circuit and removes the run pulse generator inhibit. Thereafter, because of the feedback synchronization connection through the feedback circuit means, gating signals from the run pulse generator will continue to be generated to maintain the inverter circuit running in an oscillating condition for so long as the suitable pan load is present and induction heating excitation is desired or called for by a pan temperature sensor, should one be used.

BRIEF DESCRIPTION OF THE DRAWINGS

These and other objects, features and many of the attendant advantages of this invention will be appreciated more readily as the same becomes better understood by reference to the following detailed description when considered in connection with the accompanying drawings, wherein like parts in each of the several figures are identified by the same reference character, and wherein:

FIG. 12 is a schematic circuit diagram of an alternative connection for the circuit of FIG. 4 illustrating the manner in which the output from a pan temperature sensor circuit could be used with an induction cooking unit in conjunction with a pan presence detector and control according to the invention;

DETAILED DESCRIPTION OF PREFERRED EMBODIMENTS

Figures 1, 2A, 2B, 2C:
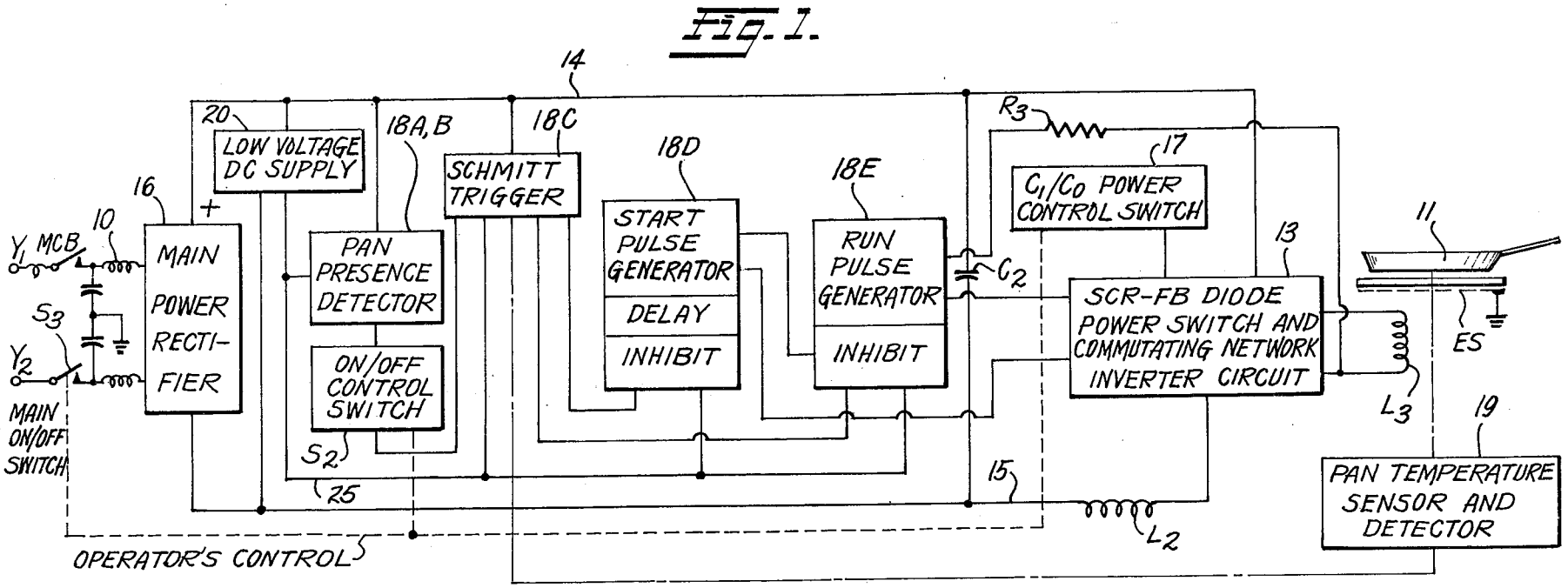
FIG. 1 is a functional block diagram of a new and improved induction cooking unit constructed according to the invention and which possesses essentially zero stand-by power loss.
FIGS. 2A, 2B and 2C are partial sectional views of the physical arrangement of an induction heating coil, and pan presence sensing coil constructed and located according to the invention.

FIG. 1 of the drawings is a functional block diagram of a new and improved induction heating unit having an essentially zero stand-by power requirement and constructed according to the invention. In FIG. 1, a suitable pan or other metal base cookware 11 is disposed in inductive coupling relationship with an induction heating coil ($L_3$) that is excited with periodic, high frequency energization currents that cause the pan 11 to be inductively heated. For a more detailed description of the physical phenomenon whereby heating occurs in the pan 11, reference is made to the above-identified U.S. Pat. No. 3,710,062, the disclosure of which is hereby incorporated in its entirety. A high frequency power inverter circuit 13 produces the periodic, high frequency current which drives the induction heating coil L3 and its construction and operation is described more fully in U.S Pat. No. 3,710,062 with relation to FIG. 2A thereof. Inverter circuit 13 is powered from either a DC or a partially filtered full-wave rectified voltage applied between conductors 14 and 15. Main input power is applied to the cooking unit from any AC or DC residential or commercial source connected to input terminals Y1 and Y2, and passes to a main power rectifier 16 through main circuit breaker (MCB), operator's on-off line control switch S3 and EMI filter 10. The output of rectifier 16 connects to conductors 14 and 15. For the purpose of the present description, the input power to the cooking unit will be assumed to be a 115 volts, 60 cycle, 15–20 amp supply conventionally used in the United States for home electrical service. If desired, a 230 volts, 20 amp or any other conventionally used source of alternating current could be employed, provided, of course, that the voltage and current ratings of the components used in the system are made compatible with the electrical supply source The full wave rectified output voltage appearing across the power supply conductors 14 and 15 is partially filtered by a capacitor $C_2$ connected across these conductors. RF power delivered by the inverter circuit 13 is under the control of a $C_1/C_0$ power control switch 17 as described more fully in the above-referenced, U.S. Pat. No. 3,886,342, the disclosure of which is hereby incorporated in its entirety. A filter inductor $L_2$ is connected in series circuit relationship with the power inverter 13 across the power supply conductors 14 and 15 and capacitor $C_2$, and has a value related to the operating frequency of the power inverter circuit 13 as described more fully in the above-referenced U.S. Pat. No. 3,710,061.

The power inverter circuit 13 includes a silicon controlled rectifier SCR and feedback diode pair which is gated into conduction first by a delayed start gate-pulse generator circuit 18D and thereafter during each operating cycle of the power inverter circuit 13 by a $t_2$-timer run gate-pulse generator circuit 18E. Both of these sub-circuits are under the control of a pan selective sensor and detector circuit 18A, B and of an on/off switch $S_2$ and Schmitt trigger circuit 18C. During operation of the circuit, the selective pan presence detector 18A, B and start pulse generator 18D, initially start the power inverter circuit 13 by generating and applying a start pulse to the control gate of the (SCR) thyristor device comprising a part of the inverter circuit 13, but only when a suitable pan load 11 is placed over the induction cooking coil $L_3$. and switch $S_2$ is closed. Thereafter, during succeeding running periods, run gating pulses are supplied to the SCR from the $t_2$-timer run pulse generator 18E after the inverter has once been enabled by the pan presence detector circuit 18A, B, and an initial start pulse has been supplied by start pulse generator 18A, as will be described more fully hereinafter in conjuncton with FIG. 4 of the drawings.

Upon the initial closure of line switch S3 power is supplied to a low voltage DC supply 20 from the main power rectifier 16 to allow the low voltage supply 20 to build up and in turn provide energizing potentials to the pan detector, Schmitt trigger, start pulse generator and run pulse generator circuits, to condition these circuits for operation. In an appliance it is mandatory to be able to remove power entirely from all internal circuit components when the cooking unit is in a turned-off state. Therefore, line switch S3 is designated as the operator's main on/off control switch to allow this requirement to be met. In this mode, switch S2 is used only to stop and re-start the power inverter 13 by controlling the production of gating signals supplied to the main SCR of inverter 13 whenever the RF lever Cl/Co control switch 17 is changed from one position to another. For this purpose the operation of switch S2 is linked with the operation of Cl/Co switch 17 so that switch S2 is closed except when the position of switch 17 is being changed during which intervals switch S3 remains closed. Main power switch S3 may also be linked to switches S2 and 17 so that main power is applied to the cooking unit in a sequence such that the Cl/Co switch 17 is in its lowest power position when switch S3 is initially closed to apply power to the unit. Switch S3 then remains closed for all other power positions of the combination of switches [S3, S2, 17].

In the presence of a proper pan load and with a switch S2 closed, the start pulse generator 18D will produce a start pulse following a suitable delay in time. The delay in the production of the start pulse allows for the conditioning of the pulse generator circuits after the closure of S3, and also fixes the minimum time which must elapse before the power inverter can be re-started following a change in the position of RF power switch 17. The start-up delay is re-activated each time the switch 17 makes contact at a new RF power position so that as long as the switch is being moved from one position to another by the operator in a time shorter than the delay time, no start-up pulse will be generated and the inverter will remain inhibited. This behaviour prevents restarting of the inverter at a rate which is dependent upon the rate with which the operator moves the power control switch and prevents re-starting until sufficient time has elapsed for all residual RF energy in the inverter circuit to be dissipated.

If desired, a pan temperature sensor and detector 19 may be included in more sophisticated induction cooking units whereby the temperature of the metal base cookware being inductively heated can be maintained within close tolerances. For this purpose, the temperature of the bottom of the pan 11 is sensed and an output control signal is produced by detector 19 which is fed back to the Schmitt trigger switch 18C to start or stop the power inverter as will be described more fully hereinafter in connection with FIG. 12 of the drawings. In a similar way a negative temperature coefficient temperature sensor may be employed to limit the upper temperature and to prevent the overheating of system components such as the induction coil or the inverter SCR.

FIG. 2A of the drawings illustrates in cross-section a preferred physical arrangement for mounting a pan sensing coil $L_5$ relative to a pan load 11 to be inductively heated by induction heating coil $L_3$. The pan 11 is physically supported immediately over the spirally-wound, pancake-shaped induction heating coil $L_3$ in inductive coupling relationship by a suitable insulating cook top 12. The cook top 12 may be fabricated from ceramic or other suitable insulating material which does not adversely influence or affect lines of magnetic flux emitted either by the induction cooking coil $L_3$ or by the pan sensing coil $L_5$. As disclosed more fully in the above-referenced U.S. Pat. No. 3,898,410 the disclosure of which is hereby incorporated in its entirety, the supporting insulating member 12 which is a part of a cool top cooking range may include a pattern of metallic foil strips on the underside of the supporting insulating member to form an electrostatic shield ES which suppresses coupling of the potential fields of coils L3 and L5 to the pan 11 above. These strips may connect to each other at least at one point but not so as to form closed conductive loops. Alternatively, the shield may consist of a thin resistive coating to shield electrostatically the potential field of these coils. The electrostatic shield is grounded preferably through a suitable radio frequency grounding capacitor (60). The shield does not adversely influence the magnetic field of either coil L3 or L5. Electromagnetic lines of flux from coils L3 and L5 are indicated by the arrows in FIG. 2B. These lines of flux couple inductively to the metal base cookware 11 through the insulating support member 12. Because of the physical arrangement of the coils, the electromagnetic lines of flux developed by coil L3 of necessity thread and cut across the conductors forming the L5 pan sensing coil.

Figures 3A, 3B, 4:
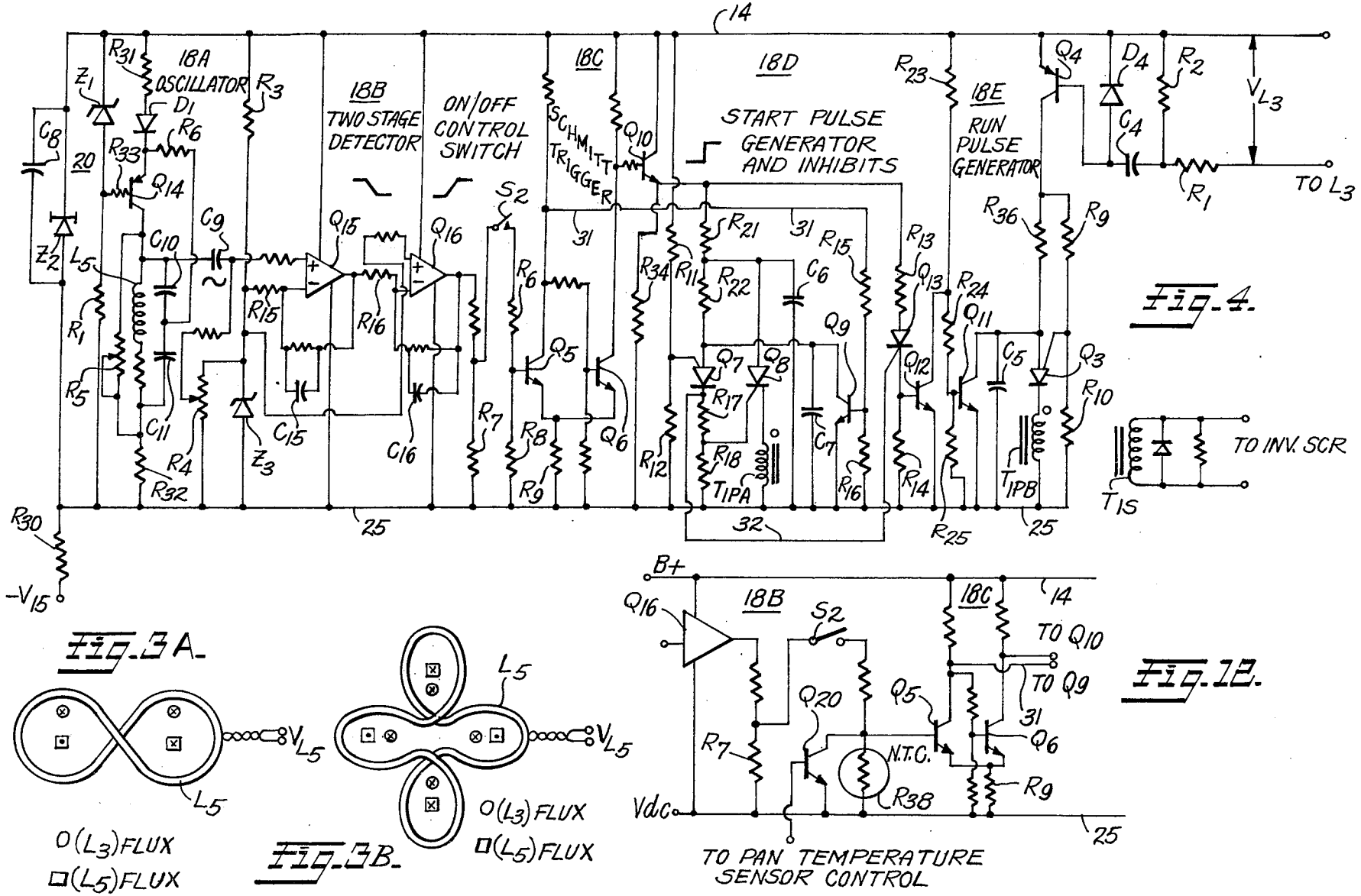
FIGS. 3A and 3B show alternate preferred design configurations of the pan presence sensing coil according to the invention.
FIG. 4 is a detailed, schematic circuit diagram of a new and improved circuit arrangement for use with the embodiment of the invention shown in FIG. 1 in block diagram form, and which includes a pan presence detector, a start pulse generator and a run pulse generator together with suitable threshold, delay and inhibit circuits, all of which are responsive to the output of the pan presence detector.

As best seen in FIGS. 3A and 3B of the drawings, the L5 pan sensing coil preferably is formed either in the shape of a figure eight or in the shape of a cloverleaf pattern or some similar multiloop pattern. The multiloop coils are formed with relatively fine wire in a manner such that each turn of the coil is comprised by a length of conductor which takes the path of a figure eight. A cloverleaf pattern may be formed as in FIG. 3B consisting of integer multiples of such figure eights. Consequently, all of the turns of the pan sensing coil L5 combine so as to create a bundle of wires of multiloop shape and of essentially planar configuration. In each of the drawings of FIG. 2 the center of the multiple loop pan sensing coil L5 is physically situated substantially on the center line of the induction heating coil L3.

In order to satisfy the condition requiring inductive coupling to the pan 11 by lines of flux from the L5 pan sensing coil, the coil L5 is unavoidably under the influence of the induction field produced by the induction heating coil L3. The situation may be understood by considering the crosses and dots designating respectively flux which is directed into or out of the plane of the drawings of FIGS. 3A and 3B. The lines of flux produced by the L3 induction heating coil thread through the separate loops of the figure eight or cloverleaf configuration of the L5 sensor coil so as to produce currents in the loops of equal magnitude and phase in a manner such that the L3 currents induced in the L5 pan sensing coil at the inverter operating frequency are effectively cancelled at the terminals of the L5 coil. The L5 coil may be fixed in position with little difficulty to achieve a null in the coupling of L3 flux to the coil L5. Flux produced by current in coil L5 acts on the pan load essentially independently of the presence of the coil L3 or of the current passing therethrough. The coil L3 acts mainly as an electrostatic shield between the coil L5 and the pan. Conversely, negligible coupling of the sensing coil magnetic field couples to the L3 coil.

A small L5 coil is preferred over one whose loop configuration occupies an area large compared to the induction coil L3. If the sensing coil is relatively large, it is easily possible for the pan to be placed so as to load the loops of the sensing coil unequally. Such positioning off can upset the null condition which prevents pickup by coil L5 of the magnetic field of the induction coil L3. When the pan is close enough to the cooking surface to allow turn-on of the power inverter, pickup of the main induction field from coil L3 at the moment the inverter turns on can then cause the pan presence detector to turn of the inverter. Thus, such pickup can prevent continuous operation of the inverter. However, when the coil is made relatively small or made with a number of loop pairs, the null condition is not perturbed sufficiently to prevent satisfactory and continuous operation of the inverter even though the pan is located quite asymmetrically on or above the cooking surface. The sensing coil L5 may be proportioned so that it fits entirely within the central opening of the induction heating coil L3, for example.

If desired, a pan temperature sensor shown at 24 in FIG. 2A, and which is described more fully in the above-referenced Pat. No. 3,710,062, may be employed. The pan temperature sensor is an infrared sensor which may be positioned immediately below the $L_5$ pan sensing coil and the $L_3$ induction heating coil in a location such that it can directly view the bottom of the pan 11 through the looped openings in the pan sensor coil $L_5$ and through the central aperture opening in the $L_3$ induction heating coil. As mentioned in U.S. Pat. No. 3,710,062, and U.S. Pat. No. 3,898,410, the electrostatic shield ES and the insulating support member 12 can be designed to permit egress of the infra-red rays emitted by the bottom of the pan 11 as the pan becomes heated due to the inductive heating effects of the $L_3$ electromagnetic high frequency field. The infra-red rays emitted from the bottom of the pan 11 and sensed by infra-red temperature sensor 24 are optically chopped by a chopping blade indicated at 52 driven by a rotating motor 53. The chopping blade 52 and motor 53 may also serve as a cooling fan for cooling the components of the induction cooking unit to thereby maintain their operating temperature within prescribed limits.

The embodiment of the invention shown in FIG. 2C is similar in most respects to that shown in FIG. 2A except for the relative position of the $L_5$ pan sensor coil and the $L_3$ induction heating coil. In those induction heating units which employ a moving coil for power control purposes, an arrangement such as that shown in FIG. 2C would be required in which $L_5$ remains stationary beneath the supporting rangetop and movement of the $L_3$ induction heating coil toward and away from the supporting sensor and the bottom of the pan 11 is employed for power control purposes. In other respects, the arrangement is entirely similar to that described with relation to FIG. 2A and would function in the same manner. A pan temperature sensor arrangement similar to that shown in FIG. 2A could be also used with the FIG. 2C species of the invention.

FIG. 4 is a detailed, schematic circuit diagram of a new and improved pan sensing and inverter control circuit according to the invention, and comprises RF local oscillator 18A, two-stage detector 18B, Schmitt-type threshold detector 18C, a delayed start pulse generator 18D and run pulse generator 18E for supplying start and run pulses, respectively, to the power inverter circuit 13. The circuit shown in FIG. 4 is designed to run at normal signal levels of about 20 volts DC and includes low voltage supply 20 for deriving a low voltage direct current potential from the full wave rectified output of the main power rectifier 16. The low voltage DC supply 20 is comprised by a zener diode $Z_2$ shunted by filter capacitor C8 and is connected in series circuit relationship with a voltage limiting resistor 30 between the main positive power supply terminal 14 of the overall induction cooking unit and negative power supply teminal 15. The regulated low voltage is produced across the terminals of zener diode $Z_2$ between terminals 14 and 25.

A radio frequency local oscillator 18A is connected to and supplied from the low voltage DC supply 20,. Preferably, the oscillator 18A is designed to oscillate at about 3 to 4 times the operating frequency of the induction cooking unit to further minimize the intercoupling effects between L3 and L5, a frequency which is typically in the range 60–90 kHz. The radio frequency oscillator is comprised by a PNP transistor Q14 having its collector connected through the L5 pan sensing coil and a suitable current limiting resistor R32 to the negative terminal 25, and having its emitter connected through a diode D1 and a self-biasing resistor R31 to the positive supply terminal 14. The base of Q14 is connected through a limiting resistor R33 to the juncture of resistor $R_1$ and zener diode Z1. The emitter of Q14 is further connected through a feedback resistor R6 to the juncture of a pair of capacitors C10 and C11 which are connected in series circuit relationship across the pan sensing coil L5 to form an oscillator tank circuit.

In order to remove the dependence of oscillation amplitude on supply voltage and to increase the dependence of oscillation amplitude on the resonant impedance of the tank circuit, the average collector curent of transistor Q14 is held at a constant level. The voltage drop across the self-biasing resistor 31 and diode D1 in the emitter circuit of transistor Q14 tends to change with supply voltage and collector loading. However, the emitter-to-base voltage of Q14 will change in a compensating manner so as to keep the sum of the self-bias voltage and the emitter-to-base voltage equal to the characteristic voltage of zener diode Z1. Thus, by feedback action, the average collector current will be made essentially invariant with changes in supply voltage and collector voltage. The amplitude of the RF voltage across coil L5 becomes similarly invariant with respect to the value of the DC supply voltage above a certain level of supply voltage and is proportional only to the resistive loading of the coil L5 by the pan load.

The circuit oscillates at a frequency determined by the resonant frequency of the tank circuit formed by the sensing coil L5 and the capacitors C10 and C11. Capacitor C11 is made much larger then C10, typically be a factor of about 10. This factor determines the amount of voltage which is fed back to the emitter of Q14 to achieve regenerative oscillations.

A variable resistor R5 is connected across coil L5 for adjusting the amplitude of the oscillatory voltage appearing across the L5 tank circuit in the absence of a pan load.

The base-to-emitter voltage of Q14 and the voltage across the diode D1 in the emitter leg of transistor Q14 change in a direction opposite to the change in the voltage across zener diode Z1 with a change in ambient temperature. As a result, temperature variation effects tend to cancel each other and the amplitude of oscillations produced by the circuit remains essentially temperature independent.

The radio frequency signal produced by oscillator 18A is supplied through a high impedance capacitor C9 to the positive input terminal of a two stage detector 18B comprised by a pair of conventional integrated circuit operational amplifiers Q15 and Q16. Operational amplifier Q16 operates as an inverting amplifier with present gain.

Operational amplifier Q15 has its output connected back to its inverting input terminal through an integrating circuit comprised by resistor R15 and capacitor C15. The inverting input terminal of the operational amplifier Q15 also is connected through a voltage limiting resistor to the juncture of a resistor R3 and zener diode Z3 connected in series circuit relationship across the low voltage DC power supply terminals 14 and 25.

The non-inverting input of Q15 is negatively biased with respect to its inverting input by preset voltage derived from a tap on a potentiometer R4 connected across Zener diode Z3.

Figure 7:
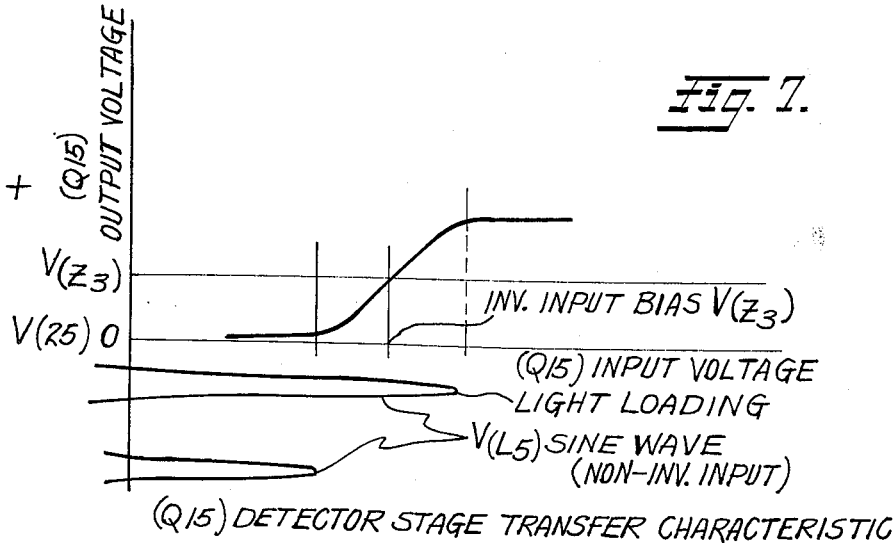
FIG. 7 shows the input-to-output voltage transfer characteristic of the detecting amplifier stage of the pan presence detector circuit included in the diagram of FIG. 4.

Behavior of the detector circuit may be better understood by reference to the transfer characteristic of the Q15 detector stage shown in FIG. 7. In the absence of any RF input via capacitor C9, the detector output Q15 is nearly zero when referred to terminal 25. When RF voltage is present from oscillator circuit 18A, this voltage is superimposed additively to the bias obtained from potentiometer R4 so as to cause the output of Q15 to increase positively once the amplitude of the positive excursion of the RF since wave input exceeds the preset bias provided by potentiometer R4. As the RF level driving Q15 increases, the output of Q15 will increase to a point of saturation as shown in FIG. 7. To place the circuit in a condition for pan detection, potentiometer R4 is set so as to cause the output of Q15 to be just saturated at its maximum positive output level under the condition that the RF voltage impressed via capacitor C9 at the non-inverting input terminal of Q15 is that RF level associated with coil L5 when it is lightly loaded by a highly conductive metal sheet placed on the surface of the cooking unit.

Referring again to FIG. 4, it may be seen that the output from the detector stage Q15 is connected to the inverting input terminal of the amplifying and inverting stage Q16 which similarly has its output connected back through a resistor-capacitor integrating network (R16, C16) to its inerting input terminal. The non-inverting input terminal of Q16 is connected back to the juncture of bias resistor R3 and zener diode Z3. The output from the inverting amplifier Q16 assumes a high (positive) level when the RF output of oscillator 18A is low, and a low level approaching zero volts when the RF output of oscillator 18A is high, as depicted by the small plots of DC output voltage versus RF input voltage shown in FIG. 4 near Q16.

The output of Q16 is used to control the operation of a Schmitt type threshold circuit 18C including transistors Q5 and Q6 to turn the power inverter on and off as is described later in this specification relative to FIG. 4.

Figure 6A:
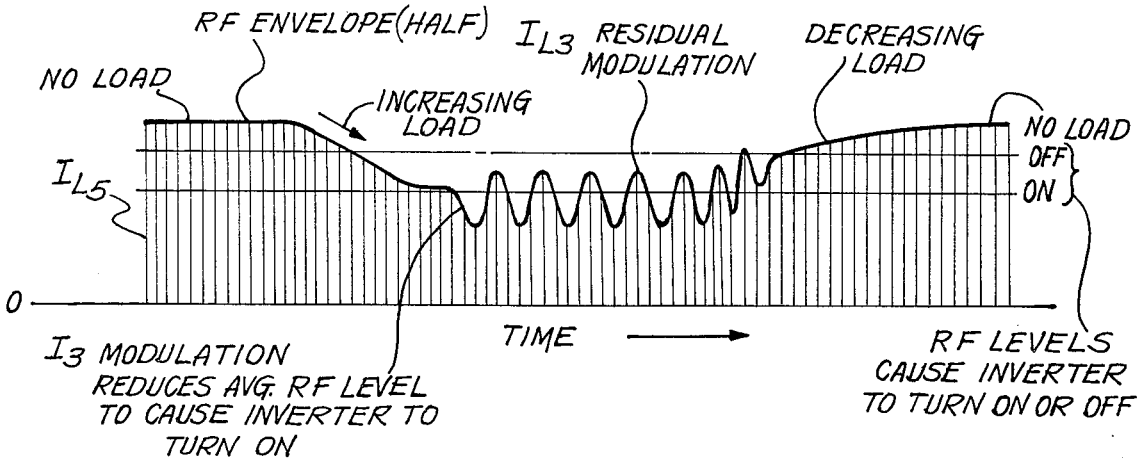
FIG. 6A is a voltage vs. time operating characteristic wave shape illustrating the effect on the oscillatory sensing signal of different amounts of loading.
Figure 6B:
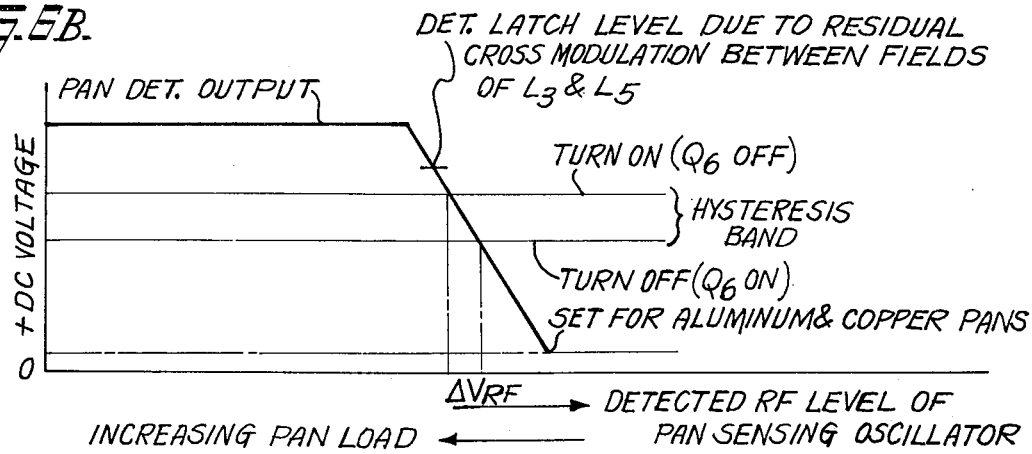
FIG. 6B is a plot of the DC output obtained from the pan presence detector included in FIG. 4 for similar changes in loading.

FIGS. 6A and 6B of the drawings illustrate the action of the pan presence detector when a proper load is applied to the cooking unit. FIG. 6A shows the change in the magnitude of the envelope of one-half of the oscillatory wave across coil L5 produced by constant current oscillator 18A as the pan load is varied from no load to a turn-on level and then returned to a no-load level. With no suitable pan 11 placed over the sensing coil L5, the oscillatory voltage appearing across the L5 sensing coil will have a maximum amplitude corresponding to that shown in FIG. 6A over the portions of the curve marked NO LOAD. Upon application of a suitable pan fabricated from a lossy material such as stainless steel, cast iron, or the like, the impedance of the sensor coil L5 will be reduced appreciably and the Q or figure of merit of the tank circuit will change from a very high value of Q to a low value of Q. As a consequence, the amplitude of the output oscillatory signal appearing across the L5 sensing coil will decrease proportionally with the degree of pan loading as is depicted in the central portion of the wave pattern shown in FIG. 6A. This portion represents a condition of heavy loading where in FIG. 7 the positive excursions of the oscillations will have decreased to the point where the sum of the bias between the tap on potentiometer R4 and the negative bus 25 plus the average value of the positive excursions will be less than the bias developed across zener diode Z3. The detector Q15 and the inverting stage Q16 outputs will then have shifted from a high value toward a low (zero) voltage value, and from a low to a high voltage value, respectively. The rate of change of state will follow the speed with which the pan load is applied or removed from the cooking surface.

FIG. 6B shows how the output of the pan presence detector increases as the RF level of the oscillator 18A decreases with increasing pan loading. Superimposed upon this response are the turn-on and turn-off levels of the Schmitt trigger 18C to which the output of detector 18B is connected. The width of the hysteresis band of the Schmitt trigger and the slope of the detector response determine the change in RF level which is required to effect turn-on of the power inverter 13. When the pan load is brought toward the pan sensing coil L5 the RF output of the pan sensing oscillator 18A decreases, the Schmitt trigger switches to the on state, and induction heating power is applied to the pan via induction coil L3. As the pan is removed away from the sensing coil, the heating power remains on until the RF amplitude of the pan sensing oscillator increases to a level higher than that at which turn-on was accomplished, as a consequence of the hysteresis associated with the Schmitt trigger. This action allows for some variation in pan position after the cooking unit has been turned on. In the absence of hysteresis the unit would be turned on and then off for essentially the same position of the pan. Once the pan has been brought close enough to the cooking surface the hysteresis feature provides a latching action to maintain the power inverter on.

FIGS. 6A and 6B also depict a condition which can arise when the null in flux between coils L5 and L3 is slightly perturbed by a pan load brought near to and finally allowed to rest on the cooking surface. As depicted, a residual modulation of the signal of the local oscillator 18A can occur if some of the flux from the main induction coil L3 couples to the sensing coil L5. The modulation is at the frequency at which the inverter operates and exists only when the inverter has been turned on. Such coupling can be dependent on the path of approach of the pan as it is brought near the cooking surface or can arise more simply when the pan is placed asymmetrically on the cooking surface so that all loops of the coil L5 are not equally loaded. Also asymmetries may develop that are due to changes in the positions of the sensing and induction coils with respect to one another as might be caused by frequent heating and cooling cycles. The effect of this modulation is to cause a decrease in the average level of the oscillations produced by oscillator 18A, since the average current passing through the sensing coil L5 is held fixed by the circuit involving Q14 as described above. The onset of the residual modulation results in an increase in the output of the pan presence detector 18B in such a way that the effective hysteresis band between the on and off states of the system increases. Such a condition is beneficial in that it imparts a strong latching-on action to the overall behavior of the pan presence detector.

If the oscillator 18A is designed so that the average collector current of Q14 is not held constant but instead is allowed to vary with loading, the average oscillation level becomes far less susceptible to modulation due to residual coupling from coil L3. However, the amplitude of the oscillations becomes more dependent on supply voltage and temperature and less sensitive to changes in the impedance of the sensing coil L5 and therefore to changes in pan position. Pan sensing circuits employing an oscillator of the type wherein the average level of the current supplying the tank circuit is not held constant, are discussed in connection with FIGS. 9 and 10.

Figure 5:
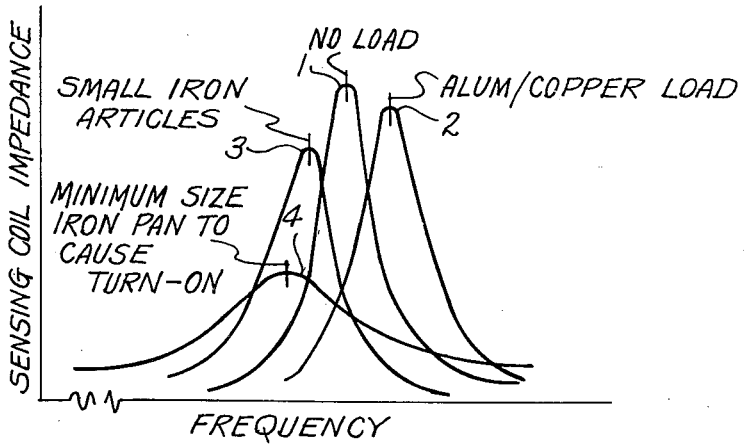
FIG. 5 illustrates certain fundamental changes in the impedance of the resonant circuit of the pan sensing coil which arise due to loading by different types of pans and of small articles.

FIG. 5 shows four impedance versus frequency curves for the tank circuit L5, C10, C11 of the high frequency pan sensing oscillator (18A). The curves illustrate the changes in impedance and the Q of the oscillator tank circuit which accompany the application of different types of pan loads over sensing coil L5 as well as other kinds of conductive articles that can be placed on an induction cooking unit designed for home range purposes. Curve 1 depicts the unloaded Q and operating frequency of the oscillator circuit, corresponding to the condition that no pan or other metallic article is in position above the cooking and sensing coils L3 and L5. Curve 2 shows that the resonant frequency of the L5 tank circuit increases and the Q of the tank circuit decreases slightly under circumstances where highly conductive and low-loss pans or other cookware fabricated from materials such as aluminum, copper, or various alloys of these metal are placed in inductive coupling relationship with the L5 tank circuit. The curve mrked 3 illustrates the effect on the tank circuit resonant frequency and Q caused by small iron-based articles such as knives, forks, spoons, spatulas, and other similar kitchen utensils which are inadvertently allowed to rest on the cooktop. As depicted in curve 3, the operating frequency of the oscillator decreases slightly from its unloaded value due to the magnetic properties of the metals from which such articles are often made. Curve 4 illustrates the sharp decrease in impedance and Q of the L5 tank circuit caused by the placement of a suitable, lossy pan load formed from iron, stainless steel or alloys of these and other lossy materials in inductive coupling relationship with the L5 sensing coil. The relatively large decrease in impedance level causes a corresponding reduction in the amplitude and frequency at which the oscillator 18A will oscillate. From FIG. 5 it will be appreciated, therefor, that the production of either high or low level oscillations depends on the type of material of which an object placed in the vicinity of the cooking surface is made. It should be noted in considering FIG. 5 of the drawings that pans which are fabricated mainly of stainless steel but coated with an exterior cladding of a highly conductive material such as copper or aluminum do not comprise suitable loads for the induction cooking unit since such loads will be only slightly heated by the induction field.

Considering the above behavior, it is clear that the pan presence detector will readily differentiate between cookware with exterior bottom surfaces made of highly conductive metals and cookware having an exterior bottom surface made of lossy iron or stainless steel such as can be used satisfactorily with the induction cooking unit. As a result, the power inverter will not turn on when an aluminum pan is placed on the cooking surface, even through the inverter may safely commutate on and off with such a highy conductive load. Such a load causes a large increase in the RF current circulating in the induction coil and this current level may be sufficient to cause excessive heating of the induction coil and considerable power loss in the inverter circuit. The selective detection feature of the pan presence detector prevents inverter operation altogether in the presence of such loads. This feature also inhibits inverter operation when a static magnetic field exists in the vicinity of the cooktop.

Returning to FIG. 4 of the drawings, it may be seen that the change in output voltage level appearing at the output of inverter stage Q16 appears across load resistor R7. This control signal is supplied through normally closed switch S2 to a pair of voltage dividing resistors R6, R8. As explained previously, switch S2 is ganged with the Cl/CO power level control switch S1 turn off the inverter whenever it is desired to change power level by changing commutating capacitance with switch S1. By this means it is assured that the power inverter cannot be running while changes in the power setting are being made by an operator of the unit. The juncture of the voltage dividing resistors R6, R8) is connected to the base electrode of an NPN transistor Q5. Transistor $Q_5$ in conjunction with a second NPN transistor $Q_6$ comprises a conventional Schmitt trigger circuit in which the emitters of $Q_5$ and $Q_6$ are connected through a common emitter load resistor $R_9$ to the negative low voltage DC supply terminal 25. The collectors $Q_5$ and $Q_6$ are connected through respective collector load resistors to the positive DC supply terminal 14. The collector of $Q_5$ also is connected through a pair of voltage dividing resistors back to negative terminal 25 and the juncture of this last mentioned pair of voltage dividing resistors is connected to the base of transistor $Q_6$. Because of the common cathode coupling through the resistor $R_9$ and the bias applied to the base of te $Q_6$ transistor, $Q_6$ normally turns on and conducts while $Q_5$ is maintained off. Under no load operating conditions, the amplifier $Q_{16}$ is at its low voltage output level, $Q_5$ is off, and the bias supplied to the base of transistor $Q_6$ maintains this transistor in a normally-on or conducting condition.

The collector of transistor $Q_6$ in Schmitt trigger circuit 18C is connected to control operation of a delayed start pulse generator 18D that functions to produce an initial starting pulse for application to the control gate of the SCR thyristor employed in the high power inverter circuit used to excite the induction heating coil $L_3$. For this purpose, the collector of transistor $Q_6$ is connected through a small limiting resistor to the base of an NPN transistor $Q_{10}$ having its collector connected directly to the positive supply terminal (14). The emitter of transistor $Q_{10}$ is connected through a resistor $R_{13}$ to the anode of a signal level silicon control rectifier SCR $Q_{13}$ having its cathode connected through a load resistor $R_{14}$ to the negative supply terminal 25. The emitter of transistor $Q_{10}$ is also connected to terminal 25 through a load resistor $R_{34}$. The gate of SCR $Q_{13}$ is connected back through a conductor 32 across a pair of load resistors $R_{17}$ and $R_{18}$ of a programmable unijunction trasistor PUT $Q_7$ for a purpose which will be described hereinafter.

The collector electrode of a transistor $Q_5$ in Schmmitt trigger circuit 18C is connected through a conductor 31 and voltage dividing resistors $R_{15}$ and $R_{16}$ to the negative supply terminal 25. The juncture of the resistors $R_{15}$ and $R_{16}$ is connected to the base electrode of an NPN transistor $Q_9$ which has its emitter connected directly to the negative terminal 25 of the low voltage DC supply. The collector of $Q_9$ is connected to the positive electrode of a charging capacitor $C_7$ also having its negative electrode connected to the low voltage DC supply negative terminal 25. The collector of transistor $Q_9$ and positive terminal of charging capacitor $C_7$ also are connected to the anode of a programmable unijunction transistor PUT $Q_7$, and the anode of PUT $Q_7$ is connected through a pair of limiting resistors $R_{21}$ and $R_{22}$ to the emitter of enabling transistor $Q_{10}$. The cathode of PUT $Q_7$ is connected through the load resistors $R_{17}$ and $R_{18}$ to the negative DC power supply terminal 25 and the gate of PUT $Q_7$ is connected to the juncture of a pair of voltage dividing resistors $R_{11}$ and $R_{12}$ which are connected in series circuit relationship across the low voltage DC power supply terminals 14 and 25 and serve to apply a fixed bias at their juncture to the gate of PUT $Q_7$.

The juncture of the load dividing resistors $R_{17}$ and $R_{18}$ in the cathode of PUT $Q_7$ is connected to the gate electrode of a SCR $Q_8$ having its anode connected directly to the juncture of the resistors $R_{21}$ and $R_{22}$ in the anode circuit of PUT $Q_7$, and having its cathode connected through one primary winding $T_{1PA}$ of pulse transformer $T_1$ to the negative power supply terminal 25. A pulse energy storage capacitor $C_6$ is connected in parallel circuit relationship across the SCR $Q_8$ and series connected primary winding $T_{1PA}$.

Upon the circuit being placed in operation, and in the absence of a suitable pan load, the start pulse generator 18D will function in the following manner. Initially, the circuit will cause the transistor $Q_6$ in Schmitt trigger ciruit 18C to be normally on and conducting as stated previously. Under this condition, transistor $Q_{10}$ will be maintained turned-off, as will be transistor $Q_5$. With $Q_5$ off, a positive enabling potential is supplied to the base of NPN transistor $Q_9$ maintaining this transistor turned-on and no charge can be built up across the charging capacitor $C_7$ due to the clamping action of $Q_9$ in the conducting condition.

Upon the appearance of a proper pan load in the vicinity of cooking coil $L_3$ and sensing coil $L_5$, the output voltage from amplifier stage $Q_{16}$ in the pan detector circuit will go from a low voltage to a high voltage value as described previously with relation to FIG. 6. This will cause Schmitt trigger 18C to switch its operating state whereby Q5 is turned-on and Q6 off. With Q5 turned on, the base Q9 will be driven toward the potential of terminal 25 causing Q9 to turn off so that C7 may be charged. Concurrently, Q6 turns off and allows Q10 to turn on and apply charging potential to capacitor C7 through resistors R21 and R22. With time, the voltage across capacitor C7 which is applied to the anode of PUT $Q_7$ will reach a predetermined firing value relative to the bias established by resistors R11 and R12, and Q7 will be fired. The time at which Q7 fires will be determined primarily by the RC time constant of capacitor C7 and resistors R21 and R22 and by the ratio of the PUT gate bias level to the DC low voltage supply level. Concurrently with the charging of C7, capacitor C6 will charge through resistor R21 following turn-on of Q10. The combination R21, C6 has relatively short time constant so that C6 will be fully charged well in advance of the turn-on of Q7. After Q7 turns on, it will produce a positive polarity gating pulse across the resistor R18 that is applied to the control gate of SCR Q8 causing Q8 to turn-on. Once SCR Q8 has fired it remains on and the potential of the juncture of resistors R21 and R22 drops and remains close to zero. Capacitor C7 will not recharge to allow repeated firing of PUT Q7 because SCR Q8, once fired, remains on due to a current flow through resistor R21 which is greater than the holding current of Q8. Thus, only a single start pulse is generated following the initial time delay in response to the turn-on of transistor Q5 by the operation of the pan detector 18A, 18B and the closure of switch S2.

Turn-on of Q8 causes capacitor C6 to be discharged through Q8 and the primary winding $T_{1PA}$ of a three-winding pulse transformer $T_1$. Primary winding $T_{1PA}$ is inductively coupled to a secondary winding $T_{1S}$ that in turn, is connected to the control gate of the power SCR thyristor in the power inverter. Thus, the discharge of capacitor C6 thru Q8 and winding $T_{1PA}$ generates a start pulse which turns on the main power SCR thyristor of the induction cooking power inverter.

Simultaneously with the production of an inital turn-on gating pulse that is supplied though the gating transformer $T_1$ to the power SCR thyristor, a turn-on pulse also will be supplied across the conductor 32 from the cathode of PUT Q7 to the control gate of SCR Q13 causing Q13 to turn on. Turn-on of Q13 raises the base potential of a transistor Q12 to turn it on and thereby to turn off transistor Q11 by shunting away the base current to Q11 which normally is supplied from the juncture of a pair of voltage dividing resistors $R_{24}$ and $R_{25}$ connected in series circuit relationship with a third voltage dividing resistor $R_{23}$ across the low voltage direct current power supply terminals 14 and 25. As a consequence of this connection, $Q_{11}$ normally is biased to be in a conducting condition so as to clamp the timing capacitor $C_5$ in the run pulse generator circuit 18E to the voltage of the negative supply terminal 25. Thus, upon turn-on of SCR $Q_{13}$, at the moment that the start pulse is generated, $Q_{12}$ turns-on causing $Q_{11}$ to turn off and thereby remove the inhibit on the charging of the timing capacitor $C_5$ in run pulse generator 18E.

Run pulse generator 18E is comprised by second PUT $Q_3$ having its cathode connected through a secondary primary winding $T_{1PB}$ of gating pulse transformer $T_1$ to the negtive power supply terminal 25. The anode of Put$Q_3$ is connected through a limiting resistor $R_{36}$ to the collector of an enabling transistor $Q_4$. The juncture of the collector of $Q_4$ with limiting resistor $R_{36}$, is connected through a pair of voltage dividing resistors $R_9$ and $R_{10}$ to the negative power supply terminal 25 and the juncture of $R_9$ and $R_{10}$ is connected to the gate of PUT$Q_3$. A charging capacitor $C_5$ is connected across the anode of PUT $Q_3$ to the negative power supply terminal 25 and the inhibiting transistor $Q_{11}$ is connected across the charging capacitor $C_5$. Thus, it will be appreciated that upon inhibiting transistor $Q_{11}$ being rendered non-conductive (assuming that enabling transistor $Q_4$ is turned on), then charging capacitor $C_5$ will be allowed to charge to a level sufficient to cause $Q_3$ to fire and discharge $C_5$ thru winding $T_{1PB}$ to produce a gating-on pulse on a repetitive (running) basis. The repeated (running) pulses are coupled through the second of the primary windings $T_{1PB}$ and secondary winding $T_{1S}$ to fire the power SCR thyristor in the power inverter circuit continuously following the initial starting pulse produced in winding $T_{1PA}$ by start pulse generator 18D.

The enabling transistor $Q_4$ has its base connected to a resistor capacitor differentiating network comprised by capacitor $C_4$ and resistors $R_1$ and $R_2$. A diode $D_4$ is connected between the base and emitter of $Q_4$ to limit reverse current flow through the transistor. The juncture of capacitor $C_4$ with resistor $R_2$ is connected through resistor $R_1$ to the $L_3$ induction heating coil for sensing the value of the voltage developed across the $L_3$ heating coil.

As described more fully in U.S. Pat. No. 3,886,342 with relation to FIG. 2 thereof, upon the power thyristor in the inverter circuit being rendered conductive, a feedback voltage VL3 is developed which is fed back through the differentiating network (C4, R2 to the base of transistor Q4 and diode D4 causing Q4 to turn on and to be held on for a period of time during the negative excursions of the voltage VL3 [referred to conductor 14] corresponding to the $t_2$ charging time of the main power inverter. Shortly after the voltage VL3 has passed through a maximum negative value, the current supplied to the gate of Q4 decreases to a level which causes Q4 to cease conducting so that the voltage between its collector and the negative supply bus 25 begins to decrease rapidly. It is this potential that provides charging current to capacitor C5 through resistor R36 and also determines the potential of the gate electrode of PUT Q3 through resistors R9 and R10. During the first portion of the negative half cycle of the voltage VL3 when Q4 is conducting, the capacitor C5 charges so that the potential of the anode of PUT Q3 rises toward the potential of the collector of transistor Q4. As Q4 turns off, the supply potential to PUT Q3 is removed and the potential of the gate of PUT Q3 drops rapidly to the level of the potential across capacitor C5. When the gate potential drops just below that of the anode, the PUT Q3 fires into an on-state and the capacitor C5 is discharged into the transformer winding $T1_{PB}$ to produce a second gating-on pulse at the gate of the main SCR. This and subsequent running pulses will be generated once every cycle of the voltage VL3 to maintain the power inverter in an oscillating or running condition. This running condition is described more fully in the above-referenced, U.S. Pat. No. 3,886,342. It will be appreciated, however, that the running condition could not have been established without first removing the inhibit on the charging capacitor $C_5$ and producing a start gating pulse through the start pulse winding $T_{1PA}$.

After a running condition of the induction heating unit power inverter has been established in the above-described manner to appropriately heat a pan or other metal base cooking vessel load, turn-off is as follows. Assuming that the pan load 11 has been removed, the signal amplitude of pan presence oscillator 18A will revert to its larger level of amplitude depicted in FIG. 6 for the no load condition. This will cause the output of detector stage Q15 to revert to its high voltage level and the output of amplifying stage Q16 to revert to its low voltage level. This occurrence results in turning off Q5 and allowing Q6 to turn-on. Turn-on of Q6 results in turn-off of Q10 which, in turn, turns off Q12 and Q13 and allows Q11 to turn-on, thereby re-establishing the inhibiting clamp across charging capacitor C5 to prevent the regeneration of running pulses by PUT Q3 and thereby cause shut-down of the power inverter. Similarly, turn-off of Q5 allows Q9 to turn on and to re-establish the inhibiting clamp across capacitor C7. Thus, the circuit will be returned to its initial non-operating, stand-by condition ready for a new start-up cycle of operation upon placement of a proper pan load over the induction cooking coil, It might be well to recall, that during the running periods, production of additional start pulses through the start pulse winding $T_{1PA}$ by the start pulse generator 18D is effectively prevented by the latching-on of SCR Q8 via resistor R21. Also, once fired, SCR Q13 remains in a conducting state due to current passing through Q10 and R13, and Q13 does not turn-off until Q10 is turned off. When Q10 turns off, the clamp across C7 is reimposed by Q9 so that neither C6 or C7 can be charged until Q10 is again turned on at the initiation of a new start-up period of operation as described previously. It can be appreciated that the inverter ceases to oscillate the moment the clamping transistor Q11 turns on. Thereafter, the voltage across the induction coil L3 rapidly decays to zero within a time comparable to a few cycles of the inverter frequency.

Figure 8:
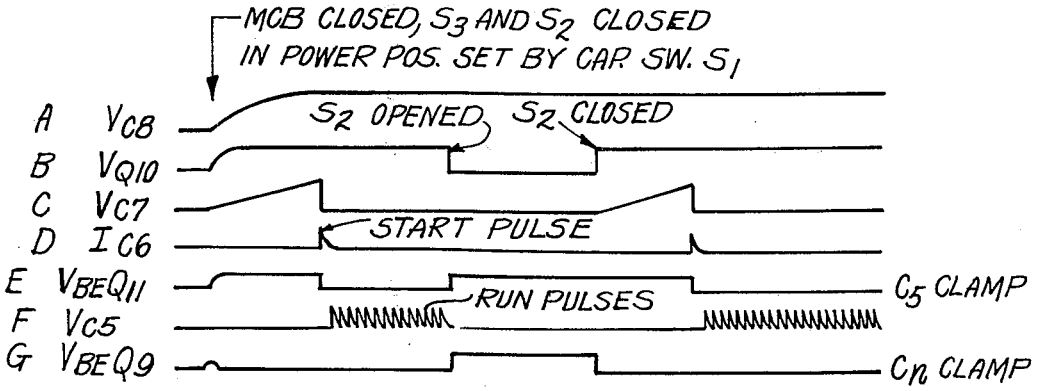
FIG. 8 shows a series of characteristic wave shapes of the signals appearing at different points in the circuit shown in FIG. 4.

FIGS. 8A–G are a series of wave shapes indicating various operating conditions occurring at different points in the circuit of FIG. 4 from the time the induction heating unit is turned on with switch S3. It is assumed that a suitable pan load is present and that S2 is closed in a power position of switch S1. As will be seen in FIG. 8A, upon closure of the master circuit breaker MCB and operator switch S3 the voltage on power supply smoothing capacitor C8 rises gradually to its full (20 volt) value typically within a few milliseconds. FIG. 8B illustrates the emitter voltage of transistor Q10 from the time line voltage is applied and for subsequent openings and closures of switch S2. FIG. 8C illustrates the build-up in voltage across the start-up timing capacitor C7 with time. The production of an initial turn-on start pulse is illustrated in FIG. 8D upon termination of the saw-toothed wave shape charging voltage $V_{C7}$ across charging capacitor C7. This start pulse is shown as $I_{C6}$ and represents the current flowing through capacitor C6 upon turn-on of the SCR Q8. The base-to-emitter voltage of clamping transistor Q11 is illustrated in FIG. 8E wherein it is seen that this voltage is present until the occurrence of a turn-on gating pulse produced by the firing of PUT Q7 whence SCR Q13 and transistor Q12 turn-on and transistor Q11 turns off. FIG. 8F depicts the run pulses appearing across winding $T_{1PB}$ due to the periodic discharge of capacitor C5. By comparison to FIG. 8C it can be appreciated that the running pulse time constant of C5, R36 is made several orders of magnitude less than the delay time constant of the start-up timing capacitor C7. Capacitors C6 and C5 are made to have essentially equal capacitances to assure that the start and run pulses will be of nearly equal duration and magnitude. Finally, FIG. 8G depicts the base-to-emitter voltage of transistor Q9 showing the removal of this clamp across capacitor C7 during conditions for which the start pulse generator 18D and run pulse generator 18E are enabled by the setting of the Schmitt trigger 18C in the appropriate state.

FIG. 12 of the drawings is a detailed schematic circuit diagram of a modification of the circuit shown in FIG. 4 showing the manner in which the output control signal obtained from the pan temperature sensor circuit shown in block diagram form at 19 in FIG. 1, can be connected to control the turn-on and turn-off of the start and run pulse generators through the medium of the Schmitt trigger circuit 18C. This control would be in addition to and complement the pan presence detector control supplied from the output of the detector operational amplifier Q16. The pan temperature sensor may be similar to the pan temperature sensor control circuit described in detail in U.S. Pat. No. 3,710,062. The pan temperature sensor is designed to view the bottom of a pan or other metal base cookware being inductively heated, and to produce an output control signal indicative of whether or not additional heat is required in order to satisfy a particular pan temperature setting established by the pan temperature sensor control. In the embodiment shown in FIG. 12 it is assumed that the pan temperature sensor control circuit is designed to provide a positive polarity output control signal under conditions where the control circuit calls for the removal of induced heat from the pan or other metal base cookware and zero signal when the control circuit calls for the application of induced heat.

Upon the metal base cookware attaining a pre-set temperature, a positive control signal from the temperature sensor appears at the base of clamping transistor Q20 causing Q20 to turn on. Thereafter, for so long as Q20 remains conducting, Q20 clamps the base electrode of transistor $Q_5$ in Schmitt trigger 18C close to the potential of the negative polarity terminal 25 causing Q5 to be maintained off and allowing Q6 to turn on. As described previously, this results in re-establishing the clamps across the charging capacitors $C_5$ and $C_7$ and prevent energization of the induction heating coil by the power inverter circuit. Upon the cooling of the pan or other metal base cookware below the preset temperature so that the pan temperature sensor circuit calls for additional heat, the control signal applied to the base of $Q_{20}$ will return to zero and $Q_{20}$ will be turned off. With $Q_{20}$ off, the output from $Q_{16}$ of the pan presence detector and the switch $S_2$ will again control turn-on and turn-off of $Q_5$ in the Schmitt trigger 18C as described previously.

An additional safegard is included in the circuit of FIG. 12 and comprises a negative temperature coefficient resistor $R_{38}$ which is connected between the base of the transistor $Q_5$ in Schmitt trigger 18C and the negative polarity DC supply terminal 25. Negative temperature coefficient resistor R38 is positioned in thermal coupling relationship with the induction heating coil $L_3$ so as to be responsive to the temperature of this coil. The resistance of resistor R38 is chosen so that it will decrease to a value which is sufficiently low to cause transistor Q5 to turn off in the event that the induction coil becomes overheated. The same technique may be used to sense overheating of the insulating cooktop or of the pan itself. Again the result will be to clamp off or lock-out operation of the start and run pulse generators and prevent their actuation of the power SCR in the inverter circuit for so long as the overheated condition continues. After the overheated induction cooking coil cools down, the resistance of negative temperature coefficient resistor R38 will reassume its normal high resistance value so that the $Q_5$ transistor in Schmitt trigger 18C can again be controlled by the pan temperature sensor as well as by the output of the pan presence amplifier $Q_{16}$ through the on-off control switch $S_2$. If the coil has become overheated by virtue of the excess heating of a pan load and the pan is left on the cooking surface, the power inverter will be turned on and off as the negative temperature coefficient NTC resistor heats and cools, thereby preventing run-away heating of the cooking pan. The NTC resistor thereby will serve to provide an overtemperature control of the system. The long thermal time delays involved in heating and cooling the resistor by backheating from the pan through the insulating support make the technique unattractive as a means for monitoring and controlling pan temperature during a cooking process, however. Of course such control would be afforded were the resistor to be made part of a probe placed in direct contact with the pan or its contents.

Figure 9:
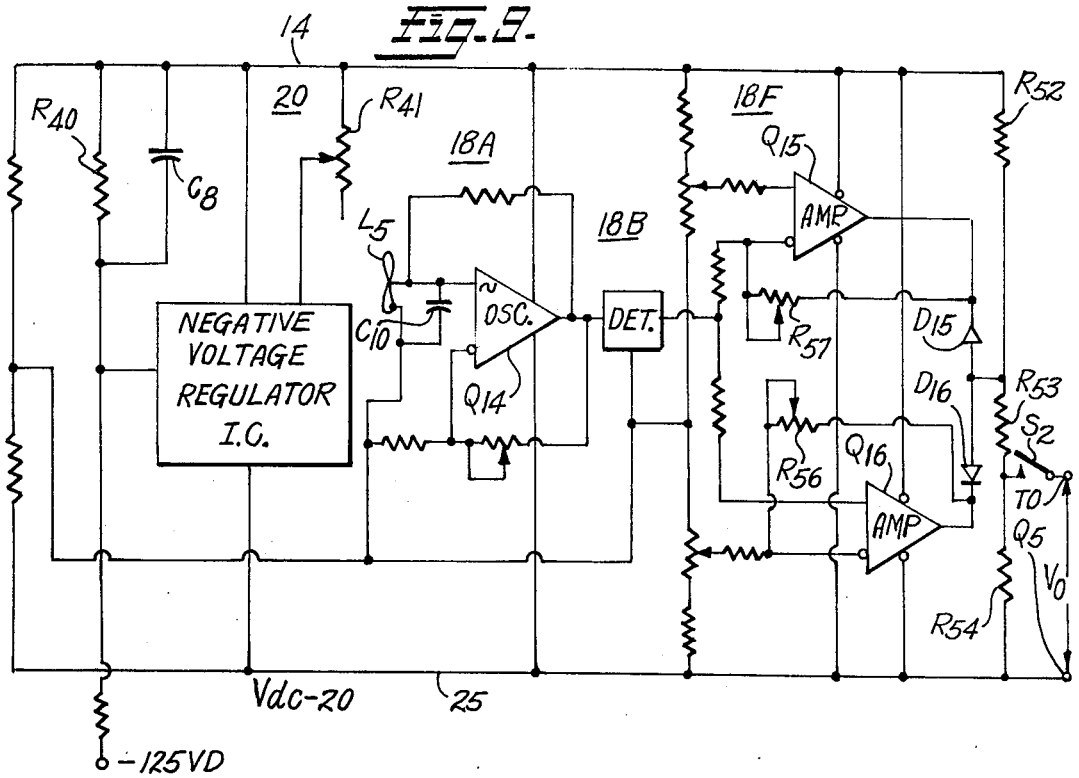
FIG. 9 is a circuit diagram of an alternative form of pan presence detector circuit constructed in accordance with the invention.

FIG. 9 of the drawings is a functional block diagram of a second embodiment of a pan presence detector and control circuit constructed in accordance with the invention. In FIG. 9, the low-voltage DC power supply 20 may include a negative voltage regulator integrated circuit device for maintaining a stable DC potential across the terminals 14 and 25 irrespective of voltage variations in the main alternating current or main DC power rectifier supply, or of variations in temperature. The pan presence sensor coil L5 is connected to integrated circuit amplifier Q14 in an oscillator circuit 18A so as to cause the generation of sinusoidal low-level radio frequency oscillations that are inductively coupled to metal base cookware positioned over the induction coil of the cooking unit. The output of oscillator stage 18A is connected to a detector stage 18B that, in turn, has its output connected to a window comparator 18F formed by a pair of integrated circuit operational amplifiers Q15 and Q16. The amplifiers drive a network consisting of diodes D15 and D16 and resistor chain R52, R53 and R54. The circuit parameters of amplifiers Q15 and Q16 are adjusted so that a positive DC voltage output Vo is produced across the resistor R54 only over a selected range of output voltage from oscillator 18A and no output voltage is produced for oscillator voltages outside this range. Thus, the circuit provides an adjustable voltage window within which the output Vo is other than zero. The slope of each side of the window may be preset by adjusting negative feedback resistors R56 and R57 thereby to control the voltage gain of each amplifier to achieve both system stability and a desired amount of hysteresis between the pan position which causes the inverter to turn on and that position which causes the inverter to turn off.

The detector 18B senses the amplitude of radio frequency oscillations from the oscillator 18A, the detector output is responsive to the presence or absence of a suitable lossy pan load, and the positive DC output Vo from window comparator 18F will be present only when the strength of the radio frequency oscillations and the degree of loading of the sampling coil L5 fall within a proper range. In the presence of a proper pan load, the output of the comparator and diode circuit will provide a positive turn-on signal to the turn-on/turn-off circuitry 18 C, D, E and causes the power inverter to operate. In the absence of any radio frequency oscillation, the signal from the pan sensor oscillator 18A and the detector output will be zero and outside the voltage window so that the output Vo will be zero, consequently, the power inverter will not operate. Similarly, if the radio frequency oscillations are too large to fall within the range of the comparator window 18F, then again the output Vo will be zero and the power inverter will be prevented from turning on.

Figure 11:
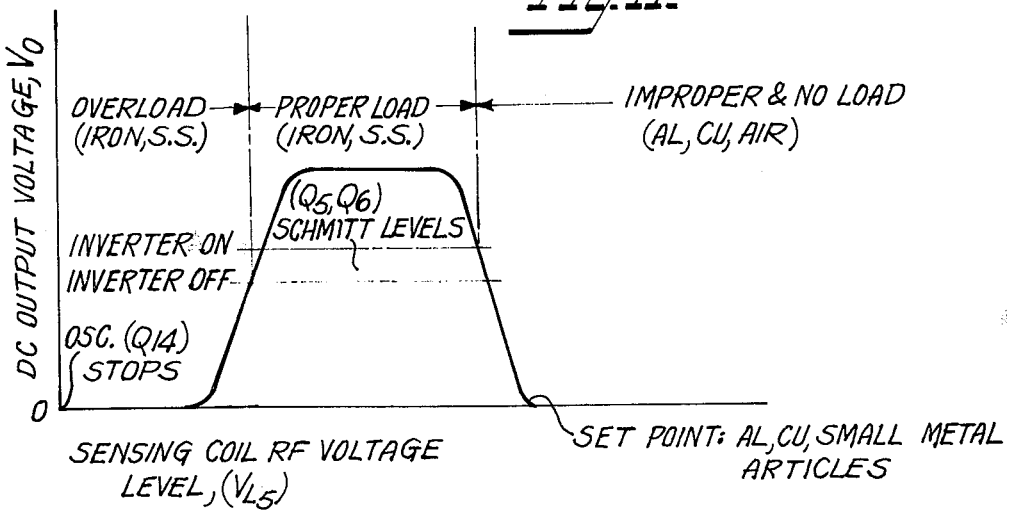
FIG. 11 is a characteristic curve plotting output voltage from the pan presence detector circuits of FIGS. 9 and 10 versus the level of the detected RF voltage across the pan sensing coil. This curve shows how loading by different articles affects pan detector output to control the power inverter in a load selective manner.

In FIG. 11 the output signal Vo appearing at the output of the comparator and diode circuit 18F is plotted versus the level of the radio frequency voltage across the sensor coil L5. It will be seen that the output voltage Vo initially is at a low zero value when there is no pan load and the oscillation level is high. The presence of a suitable pan or stainless-steel metal-base cookware causes the output Vo to increase and to reach a level at which the Schmitt trigger 18C turns on the power inverter in a manner similar to the action achieved by the output of the amplifier stage Q16 described previously in connection with FIG. 4. As mentioned above the circuit of FIG. 9 includes in addition an off-state region for very low levels of L5 coil voltage such as would be caused when the oscillator fails to turn on or when the pan loading is excessive. Thus, the circuit can be adjusted to turn off the inverter when the L3 coil is overloaded by the pan, by adjusting the location and slope of the voltage window on the side where the RF voltage is low.

In the presence of an improper pan load having a bottom exterior surface made of copper or aluminum, for example, the pan sensing oscillatory signal amplitude will decrease only slightly below the no load level since such a pan will present only a minimal load to the induction coil. With such improper loading the Vo output will drop essentially to zero and will cause turn-off or prevent turn-on of the main power inverter. The slope and location of the window on the high RF voltage side may be adjusted so that when the cooktop is fully covered by an aluminum sheet the RF voltage across L5 falls at the position marked "set" where the window output just begins to increase rapidly with decreasing RF level.

Figure 10:
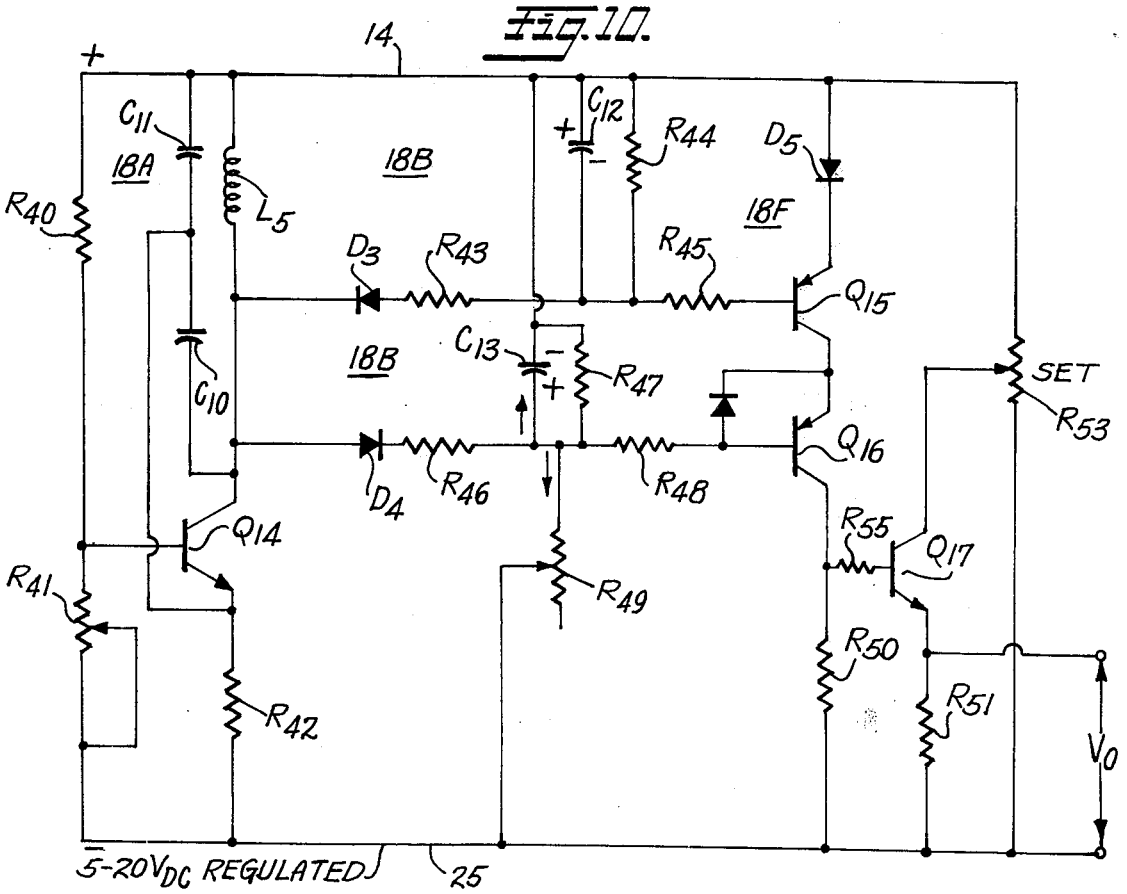
FIG. 10 is still another but more elementary form of pan presence detector constructed in accordance with the invention.

Operation in this manner may also be understood more readily from the following description of the simpler pan sensing and control circuit of FIG. 10. In FIG. 10 oscillator transistor Q14 is an NPN transistor and the sensing circuit L5 is connected to the positive terminal of the low voltage DC supply 25. This circuit is not designed to maintain constant the average collector current of oscillator Q14 as does the oscillator circuit of FIG. 4. Hence, the RF voltage developed across L5 varies directly with supply voltage and this voltage must therefore be well regulated. As in the circuits of FIGS. 4 and 9, the circuit of FIG. 10 involves the sensing of changes in the loading of the sensing coil L5 by detecting changes in the amplitude of the oscillations of oscillator Q14. Also as in FIG. 4, the oscillator portion of the circuit 18A is comprised by a tank circuit formed by the pan sensing coil L5 and the capacitors C10 and C11 whose mid-tap point is connected back to the emitter of oscillator transistor Q14. The base of Q14 is biased from a pair of biasing resistors R40 and R41 where R41 serves to adjust the amplitude of the high frequency oscillations produced.

The RF output across coil L5 from the pan sensing oscillator 18A is supplied to a detecting circuit 18B including a pair of diodes D3 and D4. The diode D3 has its anode connected through a limiting resistor R43 across an output filter network comprised by capacitor C12 and resistor R44. With the pan sensing oscillator 18A operating, radio frequency voltage will be rectified by the diode D3 and will build up a DC voltage across the filter capacitor C12 with the polarity noted so that a negative polarity voltage is applied through a limiting resistor R45 to the base of a transistor Q15 and acts to turn on this transistor. The diode D4 has its cathode connected through a limiting resistor R46 to a similar load circuit comprised by filter capacitor C13 and resistor R47. The detected RF voltage across capacitor C13 will have the polarity noted such that a positive polarity bias signal is applied through limiting resistor R48 to the base of a transistor Q16. This bias signal due to the presence of RF voltage acts to turn off transistor Q16. The base of transistor Q16 is further biased by a current derived from the DC supply which flows through the sensing coil L5, diode D4, and resistor R46 to the juncture of R48, R47, and adjustable resistor R49. Resistor R49 is adjusted to a value such that the current flowing to the base of Q16 will be too small to permit Q16 to turn on when the oscillator 18A is operating and the sensing coil L5 is very lightly loaded by a highly conductive load such as an aluminum pan.

Transistors Q15 and Q16 are series connected and are placed in series with a common load resistor R50 across the low voltage DC supply between terminals 14 and 25. Transistors Q15 and Q16 form a logical AND circuit and together with emitter follower Q17 combine to produce an output voltage Vo having a characteristic similar to that of the window circuit 18F of FIG. 9 and displayed graphically in FIG. 11. Following relay logic and in the absence of RF oscillations from oscillator 18A, transistor Q15 is normally open or off and transistor Q16 is normally closed or on.

The collector of transistor Q17 is connected to a positive voltage established at the tap of a potentiometer R53 connected across the DC supply between terminals 14 and 25. The emitter of Q17 is connected through a load resistor R51 to the negative terminal 25. The base of Q17 is driven through resistor R55 by the potential between the collector of Q16 and terminal 25. The output voltage Vo is obtained across the load resistor R51.

By reason of the circuit arrangement in FIG. 10 it will be appreciated that in the absence of any radio frequency oscillations due, for example, to failure of the oscillator 18A, no negative-going bias will be established across capacitor C12 and Q15 will not turn on. With Q15 in the turned-off condition, the output voltage $V_o$ will be at a low or zero value and the power inverter will be maintained off as described previously. However, if oscillator 18A is working properly and oscillations are being produced, these oscillations will be rectified by diode D3 and a negative bias across capacitor C12 will be produced to drive the base of transistor Q15 and cause Q15 to turn on. The resistors R43 and R44 are chosen so that the bias developed from the RF voltage is sufficient to hold Q15 turned on for a pan load which absorbs the full rated power of the power inverter being controlled, but is insufficient to hold Q15 turned on for a load which is heavier than the full load. Transistor Q16 is maintained turned on in the absence of radio frequency oscillations from oscillator 18A due to the DC bias supplied through biasing resistor R49. In the presence of radio frequency oscillations from oscillator 18A a positive polarity bias will be present across the capacitor C13 and resistor R47 that, in effect, counters the bias supplied through resistor R49. The two biases are adjusted so that transistor Q16 is maintained on over a predetermined, median level amplitude of the radio frequency oscillations produced by oscillator 18A corresponding to the presence of a suitable lossy stainless steel, iron or other similar composition pan or metal base cookware placed in the vicinity of sensing coil L5. In contrast, the presence of aluminum, copper, copper-clad stainless-steel cookware, or other highly conductive pans which would be injurious to the power inverter will cause the amplitude of the oscillations from oscillator 18A to be high. The high amplitude oscillations produce an increased positive polarity bias across the capacitor C13 which overcomes the bias from R49 causing Q16 to turn off. This effect is represented in FIG. 11 of the drawings wherein it is seen that as the amplitude of the radio frequency oscillations increase in the presence of highly conductive pan loads or for no load at all, the output of the pan sensing circuit falls to a near zero level and thereby causes the power inverter to turn off via the Schmitt trigger 18C. Accordingly, it will be appreciated that with circuit of FIG. 10, only upon the simultaneous occurrence of prescribed operating conditions including the presence of a suitable pan load and the presence of radio frequency oscillations from oscillator 18A can the power inverter be turned on. Should an improper pan load be imposed on the induction cooking unit, or should the RF oscillator fail in service for one reason or another, the pan sensing circuit of FIG. 10 will detect such conditions, and cause the induction cooking unit to turn off.

From the foregoing description, it will be appreciated that the present invention provides a new and improved induction cooking unit which has essentially zero stand-by power loss while in a turned-on stand-by condition ready for placement and heating of a suitable pan load without further adjustment by an operator of the unit. The induction cooking unit is protected against any risk of damage when used with pans or other cooking vessels of any size and fabricated from metal materials of any type. The cooking unit is load-selective and discriminates among different types of pans as well as other small articles such as knives, spoons, forks, cooking spatulas, and the like, so that it will automatically turn-on only in the presence of a proper pan load but will not turn-on in the presence of improper loads such as aluminum and copper pans, small articles and the like; thereby guaranteeing a high degree of safety to the operator as well as to the electronic components which are combined in the cooking unit. The improved induction cooking unit will not produce heating power when in a completely unloaded condition, and therefore power losses due to high RF currents which circulate unused in components of the inverter at no load are eliminated.

As a consequence of these characteristics, the invention makes available an improved pan load sensing device for use with induction cooking units which can be built into original equipment or can be retrofitted for use with preexisting induction cooking units of the same general type.

Having described several embodiments of a new and improved induction cooking unit constructed in accordance with the invention, it is believed obvious that other modifications and variations of the invention will be suggested to those skilled in the art in the light of the above teachings. It is, therefore, to be understood that changes may be made in the particular embodiments of the invention described which are within the full intended scope of the invention as defined by the appended claims.

What is claimed is:

1. In an induction cooking unit having essentially zero stand-by power requirements and comprising high frequency power inverter circuit means for developing relatively high frequency power excitation currents for supply to an induction heating coil connected to and excited by said high frequency power inverter circuit means and gating circuit means coupled to and controlling operation of the high frequency power inverter circuit means; the improvement comprising induction heating load sensing and control means for sensing the presence of a load located in induction heating relationship with respect to the induction heating coil and for controlling operation of the power inverter circuit means, said induction heating load sensing and control means comprising low power, high frequency electric sensing signal generating means for deriving a high frequency electric sensing signal having a frequency different from that at which the induction heating coil is excited, load sensing coil means coupled to and excited by said high frequency electric sensing signal generating means, said load sensing coil means being physically positionable adjacent an induction heating coil in a location to provide inductive coupling of the high frequency electric sensing signal to a load being inductively heated and including means for minimizing the effect of inductive coupling from the induction heating coil at the induction heating coil excitation frequency, detector means responsive to the high frequency electric sensing signal derived from said load sensing coil for detecting changes induced in the high frequency electric sensing signal by the presence of an induction heating load, and means for coupling the output from said detector means to control operation of the gating circuit means of an induction cooking unit.

2. An induction cooking unit according to claim 1 further including inhibit circuit means coupled to and controlled by the output from said detector means and coupled to and controlling operation of said gating circuit means for enabling a turn-on of the power inverter circuit means in the presence of a suitable pan load and for inhibiting operation of the power inverter circuit means in the absence of a suitable pan load.

3. An induction cooking unit according to claim 1 wherein the induction heating coil comprises a planar, spiraly wound induction heating coil, a flat insulating support member for supporting inductively heated cooking vessels over the induction heating coil in inductive coupling relationship, said load sensing coil means comprising a plurality of loops formed from an even number of turns of a conductor and disposed adjacent the induction heating coil to an inductive coupling relationship such that current induced in one of the loops of the load sensing coil means due to the high frequency induction field emitted by the induction heating coil cancels the current induced in a remaining loop by the same field and wherein the load sensing excitation currents supplied from the low power, high frequency electric sensing signal generating means produce magnetic fields which are additive in all of the loops to provide a heating load sensing field that is influenced primarily by a pan load and is substantially independent of the induction heating field produced by the induction heating coil.

4. An induction cooking unit according to claim 3 wherein the multiple loop load sensing coil means is formed in the nature of a figure eight pattern by individual multiple turns of the same insulated conductor and with the crossing point of the figure eight pattern being located substantially in alignment with the center of the induction heating coil.

5. An induction cooking unit according to claim 3 wherein the multiple loop load sensing coil means is formed by multiple turns of the same insulated conductor and with each turn being formed in the nature of a cloverleaf pattern having the center crossing point of the cloverleaf pattern located substantially in alignment with the center of the induction heating coil.

6. An induction cooking unit according to claim 3 wherein the planar spirally wound induction heating coil is formed with an enlarged central opening and the multi-loop load sensing coil means is located substantially within the enlarged central opening of the induction heating coil, and further comprising electrostatic shield means formed on the under surface of the flat, insulating support member for electrostatically shielding the inductively heated cooking vessel from the induction heating coil, the electrostatic shield means being electrically grounded for high radio frequencies.

7. An induction cooking unit according to claim 1 further including temperature responsive means coupled to sense the operating temperature of at least the induction heating coil, and means coupled to the output from the temperature responsive means to control the operation of said gating circuit means to cause shut-down of the induction heating unit upon an over temperature condition being sensed.

8. An induction cooking unit according to claim 1 further including pan temperature sensing means viewing the bottom of a cooking vessel and developing an output electrical control signal proportional to the inductively heated pan temperature, and means coupled to the gating circuit means and reponsive to the output of the pan temperature sensing means to control the operation of said gating circuit means in a manner to cause the pan temperature to be maintained at a desired preset value.

9. An induction cooking unit according to claim 1 further including start pulse generator means responsive to the output from the detector means for supplying start signal pulses to the gating circuit means to initiate operation of the power inverter circuit means, and run pulse generator means responsive to a feedback signal from the power inverter circuit means for deriving sustained running gating signal pulses for application to the gating circuit means for maintaining operation of the power inverter circuit means.

10. An induction cooking unit according to claim 9 further including inhibit circuit means coupled to and controlling operation of said start pulse generator means and said run pulse generator means and in turn coupled to and controlled by the output from said detector means, and wherein said detector means provides hysteresis in the response characteristics thereof to the signals supplied thereto from the load sensing coil.

11. An induction cooking unit according to claim 10 wherein the induction heating coil comprises a planar, spirally wound induction heating coil, a flat insulating support member for supporting inductively heated cooking vessels over the induction heating coil in inductive coupling relationship, said load sensing coil means comprising a plurality of loops formed from an even number of turns of a conductor and disposed adjacent the induction heating coil in inductive coupling relationship such that current induced in one of the loops of the load sensing coil means due to the high frequency induction field emitted by the induction heating coil cancels the current induced in a remaining loop by the same field and wherein the load sensing excitation currents supplied from the low power, high frequency electric sensing signal generating means produce magnetic fields which are additive in all of the loops to provide a heating load sensing field that is influenced primarily by a pan load and is substantially independent of the induction heating field produced by the induction heating coil.

12. An induction cooking unit according to claim 11 wherein the planar spirally wound induction heating coil is formed with an enlarged central opening and the multi-loop load sensing coil means is located substantially within the enlarged central opening of the induction heating coil, and further comprising electrostatic shield means formed on the under surface of the flat, insulating support member for electrostatically shielding the inductively heated cooking vessel from the induction heating coil, the electrostatic shield means being electrically grounded for high radio frequencies.

13. An induction cooking unit according to claim 12 wherein the multiple loop load sensing coil means is formed in the nature of a figure eight pattern by individual multiple turns of the same insulated conductor and with the crossing point of the figure eight pattern being located substantially in alignment with the center of the induction heating coil.

14. An induction cooking unit according to claim 12 wherein the multiple loop load sensing coil means is formed by multiple turns of the same insulated conductor and with each turn being formed in the nature of a cloverleaf pattern having the center crossing point of the cloverleaf pattern located substantially in alignment with the center of the induction heating coil.

15. An induction cooking unit according to claim 1 further including comparison circuit means responsive to the output from said detector means for comparing the output signal threreof to a present standard and for deriving an output control signal for supply to the gating circuit means of the induction cooking unit only under conditions where the output signal from the detector means conforms to the preset standard.

16. In an induction cooking unit including in combination power inverter circuit means comprising gate control tyristor means and commutation circuit means coupled together in circuit relationship and excited from a set of power supply terminals, an induction heating coil coupled to and excited by said power inverter circuit means in a manner such that the induction heating coil determines at least in part the operating frequency at which the power inverter circuit means operates, and gating circuit means coupled to and controlling turn-on of said gate control thyristor means, said gating circuit means comprising start pulse generator means coupled to supply initial turn-on gating pulses to the gate control thyristor means, feedback sensing circuit means coupled to said induction heating coil for deriving a feedback trigger signal synchronized with the frequency of operation of the commutation circuit means, run pulse gating signal generator means for generating high frequency run signal pulses having a repetition rate determined by the operation frequency of the inverter circuit means and of sufficient energy to ensure turn-on of said gate control thyristor means, enabling means coupled to and enabling initiation of operation of said run pulse gating signal generator means, and alternating current signal coupling circuit means intercoupling said last-mentioned enabling means with said feedback sensing circuit means for synchronizing the operation of the run pulse gating signal generator means with changes in frequency of the inverter circuit means due to loading and unloading of the induction heating coil; the improvement comprising induction heating load sensing means for sensing the presence of a load located in induction heating relationship with respect to said induction heating coil, said induction heating load sensing means comprising low power, high frequency electric sensing signal generating means for deriving a high frequency electric sensing signal having a frequency different from that at which the induction heating coil is excited, load sensing coil means coupled to and excited by said high frequency electric sensing signal generating means, said load sensing coil means being physically positioned adjacent the induction heating coil in a location to provide inductive coupling of the high frequency electric sensing signal to a load being inductively heated and including means for minimizing the effect of inductive coupling from the induction heating coil at the induction heating coil frequency, load sensor detector means responsive to the high frequency electric sensing signal derived from said load sensing coil for detecting changes induced in the high frequency electric sensing signal by the presence of an induction heating load, and means for coupling the output from said load sensor detector means to control operation of said start pulse generator means whereby the output from the load sensor detector means operates to turnon the high frequency power inverter circuit means in the presence of a suitable load and in the absence of a suitable load to turn-off the inverter circuit means to thereby reduce stand-by power consumption of the induction heating unit essentially to zero.

17. An induction cooking unit according to claim 15 further including inhibit circuit means coupled to and controlled by the output from said detector means and coupled to and controlling operation of said start pluse generator means and said run pulse gating signal generator means for enabling turn-on and operation of the high frequency power inverter circuit means in the presence of a suitable load and in the absence of a suitable load to inhibit operation of inverter circuit means.

18. An induction cooking unit according to claim 17 wherein the alternating current signal coupling circuit means comprises differentiating circuit means for differentiating the sensed value of the voltage developed across the induction heating coil and supplying the same back to synchronize operation of the run pulse gating signal generator means with changes in frequency of operation of the inverter circuit means due to loading and unloading of the induction heating coil.

19. An induction cooking unit according to claim 18 wherein the inverter circuit means comprises a high frequency chopper-inverter circuit means including inductor and capacitor communtating reactive components having an inductance ($L_1$) and a capacitance ($C_1$), respectively, connected in series circuit relationship across the gate controlled thyristor means in parallel circuit relationship therewith and with the chopper-inverter circuit means thus comprised being connected across a set of power supply terminals for connection to a source of excitation potential through a filter inductor having an inductance ($L_2$), said commutating inductor and capacitor being series resonant at a predetermined natural commutating frequency that provides a combined thyristor conduction and commutating period ($t_1$) during each cycle of operation and said gating circuit means controlling the turn-on of the gate controlled thyristor means so as to render the thyristor conductive at a controlled frequency of operation.

20. An induction cooking unit according to claim 19 further including a smoothing inductor having an inductance ($L_3$) and a smoothing capacitor having a capacitacne of ($C_3$) connected in series circuit relationship across at least one of the capacitor and inductor commutating reactive components, said smoothing inductor and capacitor having values such that the combined reactive impedance of the capacitor communtating reactive components including the smoothing inductor and the smoothing capacitor is capacitive in nature and series resonates with the inductor commutating component to establish the combined thyristor conduction commutating period ($t_1$) and wherein the smoothing inductor and capacitor shape the output current flowing through the smoothing inductor to substantially sinusoidal wave shape having little or no radio frequency interference emission effects and improved power coupling, and the smoothing inductor comprises the induction heating coil.

21. An induction cooking unit according to claim 20 wherein the controlled frequency of operation provides an operation period T for the chopper-inverter circuit means including a quiescent charging period $t_2$ in each cycle of operation $T = t_1+t_2$ such that the value $\omega_2 t_2$ equals substantially $\pi/2$ radians at the operating frequency or greater and where $\omega_2$ is approximately $1/\sqrt{L_2C_1}$ whereby the reapplied forward voltage across the thyristor means following each conduction interval is maintained substantially independent of load and adequate commutation energy is stored in the commutating capacitance intermediate each conduction interval of the gate control thyristor to assure safe operation of the chopper inverter circuit means.

22. An induction cooking unit according to claim 21 wherein the source of excitation potential for the induction heating unit comprises full wave rectifier means designed for connection to a source of conventional commercial or residential alternating current and having the output thereof connected across a filter capacitor of a relatively small capacitance value ($C_2$), said high frequency chopper-inverter circuit means being connected through the ($L_2$) filter inductor across the filter capacitor ($C_2$).

23. An induction cooking unit according to claim 20 wherein the induction heating coil comprises a planar, spirally wound induction heating coil, a flat insulating support member for supporting cooking vessels in inductive coupling relation over the induction heating coil, electrostatic shield means formed on the undersurface of the flat, insulating support member for elecrrostatically shielding the inductively heated cooking vessel from the induction heating coil, the electrostatic shielding means being electrically grounded for high radio frequencies, over temperature responsive means coupled to sense the operating temperature of at least the induction heating coil, and means coupled to the output from the over temperature responsive means to control the operation of said gating circuit means to cause shut-down of the induction heating unit upon an over temperature condition being sensed.

24. An induction cooking unit according to claim 16 wherein the induction heating coil comprises a planar, spirally wound induction heating coil having an enlarged central opening, a flat insulating support member for supporting cooking vessels over the induction heating coil in inductive coupling relationship, said load sensing coil means comprises a plurality of loops formed from an even number of turns of a conductor and disposed within the enlarged central opening of the induction heating coil in inductive coupling relationship with cooking vessels to be inductively heated whereby current induced in one of the loops due to the high frequency induction field emitted by the induction heating coil cancels the current induced in a remaining loop by the same field and wherein the excitation currents due to the low power, high frequency electric sensing signal generating means are additive in all of the loops to provide a heating load sensing field that is in influenced by a pan load indepencently of the induction heating field produced by the induction heating coil.

25. An induction cooking unit according to claim 24 wherein the multiple loop load sensing coil means is formed in the nature of a figure eight by individual multiple turns of the same insulated conductor and with the crossing point of the figure eight pattern being located substantially in alignment with the center of the central opening of the induction heating coil.

26. An induction heating unit according to claim 24 wherein the multiple loop load sensing coil means is formed by multiple turns of the same insulated conductor and with each turn being formed in the nature of a cloverleaf pattern having the center crossing point of the cloverleaf pattern located substantially in alignment with the center of the central opening in the induction heating coil.

27. An induction cooking unit pan load sensing device for sensing the presence of a pan load located in induction heating relationship with respect to an induction cooking coil, said pan load sensing device comprising low power, high frequency oscillatory sensing electric signal generating means for deriving high frequency electric sensing signal having a frequency different from the frequency at which the induction heating coil is excited, pan load sensing coil means coupled to and excited by said high frequency oscillator sensing electric signal generating means, said pan load sensing coil means being physically positioned adjacent an induction cooking coil in a location to provide inductive coupling of the high frequency oscillatory sensing electric signal to a pan load being inductively heated and including means for minimizing the effect of inductive coupling from the induction cooking coil, pan load sensing detector means responsive to the high frequency sensing electric signal emitted by said pan load sensing coil for detecting changes induced in the high frequency sensing electric signal by the presence of a pan load to be inductively heated, and means for deriving a control output signal from said pan load detector means to control operation of an induction cooking unit.

28. An induction cooking unit pan load sensing device according to claim 27 wherein said pan load sensing coil means comprising a plurality of loops formed from an even number of turns of a conductor to be disposed adjacent an induction heating coil in inductive coupling relationship therewith such that current induced in one of the loops due to the high frequency induction field emitted by the induction heating coils cancels the current induced in a remaining loop by the same field and wherein the excitation currents to the low power, high frequency oscillatory electric signal generating means are additive in all of the loops to provide a heating load sensing field that is influenced by a pan load independently of the induction heating field produced by an induction heating coil.

29. An induction cooking unit pan load sensing device according to claim 28 wherein the multiple loop load sensing coil means is formed in the nature of a figure eight pattern by individual multiple turns of the same insulated conductor and with the crossing point of the figure eight pattern designed to be located substantially in alignment with the center of an induction heating coil.

30. An induction cooking unit pan load sensing device according to claim 29 wherein the multiple loop load sensing coil means is formed by multiple turns of the same insulated conductor and with each turn being formed in the nature of a cloverleaf pattern having the center crossing point of the cloverleaf pattern designed to be located substantially in alignment with the center of an induction heating coil.

31. In an induction cooking unit including in combination power inverter circuit means comprising gate control thyristor means and commutation circuit means coupled together in circuit relationship and excited from a set of power supply terminals, an induction heating coil coupled to and excited by said power inverter circuit means in a manner such that the induction heating coil determines at least in part the operating frequency at which the power inverter circuit means operates, and gating circuit means coupled to and controlling turn-on of said gate control thyristor means, said gating circuit means comprising start pulse generator means coupled to supply initial turn-on gating pulses to the gate control thyristor means, feedback sensing circuit means coupled to said induction heating coil for deriving a feedback trigger signal synchronized with the frequency of operation of the commutation circuit means, run pluse gating signal generator means for generating high frquency run signal pulses having a repetition rate determined by the operation frequency of the inverter circuit means and of sufficient energy to ensure turn-on of said gate control thyristor means, enabling means coupled to an enabling initiation of operation of said run pulse gating signal generator means, and alternating current signal coupling circuit means intercoupling said last-mentioned enabling means with said feedback sensing circuit means for synchronizing the operation of the run pulse gating signal generator means with changes in frequency of the inverter circuit means due to loading and unloading of the induction heating coil; the improvement comprising induction heating load sensing means for sensing the presence of a load located in induction heating relationship with respect to said induction heating coil, and means coupling the output from said heating load sensing means to control operation of said start pulse generator means whereby the output from the heating load sensing means operates to turn-on the high frequency ppower inverter circuit means in the presence of a suitable load and in the absence of a suitable load to turn-off the inverter circuit means to thereby reduce stand-by power consumption of the induction heating unit essentially to zero.

32. An induction cooking unit according to claim 31 further including inhibit circuit means coupled to and controlled by the output from said heating load sensing means and coupled to and controlling operation of said start pulse generator means and said run pulse gating signal generator means for enabling turn-on and operation of the high frquency power inverter circuit means in the presence of a suitable load and in the absence of a suitable load to inhibit operation of inverter circuit means.

33. An induction cooking unit according to claim 32 wherein the alternating current signal coupling circuit means comprises differentiating circuit means for differentiating the sensed value of the voltage developed across the induction heating coil and supplying the same back to synchronize operation of the run pulse gating signal generator means with changes in frequency of operation of the inverter circuit emeans due to loading and unloading of the induction heating coil.

34. An induction cooking unit according to claim 32 wherein the inverter circuit means comprises a high frequency chopper-inverter circuit means including inductor and capacitor commutating reactive components having an inductance ($L_1$) and a capacitance ($C_1$), respectively, connected in series circuit relationship acorss the gate controlled thyristor means in parallel circuit relationship therewith and with the chopper-inverter circuit means thus comprised being connected across a set of power supply terminals for connection to a source of excitation potential through a filter inductor having an inductance ($L_2$), said commutating inductor and capacitor being series resonant at a predetermined natural commutating frequency that provides a combined thyristor conduction and commutating period ($t_1$) during each cycle of operation and said gating circuit means controlling the turn-on of the gate controlled thyristor means so as to render the thyristor conductive at a controlled frequency of operation.

35. An induction cooking unit according to claim 34 further including a smoothing inductor having an inductance ($L_3$) and a smoothing capacitor havinf a capacitance of ($C_3$) connected in series circuit relationship across at least one of the capacitor and inductor commutating reactive components, said smoothing inductor and capacitor having values such that the combined reactive impedance of the capacitor commutating reactive components including the smoothing inductor and th4e smoothing capacitor is capacitive in nature and series resonates with the inductor commutating component to establish the combined thyristor conduction commutating period ($t_1$) and wherein the smoothing inductor and capacitor shape the output current flowing through the smoothing inductor to substantially sinusoidal wave shape having little or no radio frequency interference emission effects and improved power coupling, and the smoothing inductor comprises the induction heating coil.

36. An induction cooking unit according to claim 35 wherein the controlled frequency of operation provides an operation period T for the chopper-inverter circuit means including a quiescent charging period $t_2$ in each cycle of operation where $T = t_1 + t_2$ such that the value $\omega_2 t_2$ equals substantially $\pi/2$ radians at the operating frequency or greater and where $\omega_2$ is approximately 1 $L_2C_1$ whereby the reapplied forward voltage across the thyristor means following each conduction interval is maintained substantially independent of load and adequate commutation energy is stored in the commutating capacitance intermediate each conduction interval of the gate control thyristor to assure safe operation of the chopper-inverter circuit means.

37. An induction cooking unit according to claim 36 wherein the source of excitation potential for the induction heating unit comprises full wave rectifier means designed for connection to a source of conventional commercial or residential alternating current and having the output thereof connected across a filter capacitor of a relatively small capacitance value ($C_2$), said high frequency chopper-inverter circuit means being connected through the ($L_2$) filter inductor across the filter capacitor ($C_2$).

38. An induction cooking unit according to claim 36 wherein the alternating current signal coupling circuit means comprises differentiating circuit means for differentiating the sensed value of the voltage developed across the induction heating coil and supplying the same back to synchronize operation of the run pulse gating signal generator means with changes in frequency of operation of the inverter circuit means due to loading and unloading of the induction heating coil.

39. An induction cooking unit according to claim 38 wherein the source of excitation potential for the induction heating unit comprises full wave rectifier means designed for connection to a source of conventional commercial or residential alternating current and having the output thereof connected across a filter capacitor of a relatively small capacitance value ($C_2$), said high frequency chopper-inverter circuit means being connected through the ($L_2$) filter inductor across the filter capacitor ($C_2$).

* * * * *